US006656879B2

(12) United States Patent
Tsutsui et al.

(10) Patent No.: US 6,656,879 B2
(45) **Date of Patent: *Dec. 2, 2003**

(54) METHOD OF REVERSIBLE SELECTIVE MANIFESTATION OF DIFFERENT STATES OF FUNCTIONAL ELEMENT

(75) Inventors: Kyoji Tsutsui, Mishima (JP); Takehito Yamaguchi, Shizuoka-ken (JP); Hideaki Ema, Shizuoka-ken (JP); Masaru Shimada, Shizuoka-ken (JP); Hiroshi Goto, Fuji (JP); Ichiro Sawamura, Numazu (JP); Eiichi Kawamura, Numazu (JP); Keishi Kubo, Yokohama (JP); Shoji Maruyama, Yokohama (JP); Hiroki Kuboyama, Mishima (JP); Keishi Taniguchi, Susono (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 08/070,859

(22) Filed: Jun. 3, 1993

(65) Prior Publication Data

US 2003/0114303 A1 Jun. 19, 2003

(30) Foreign Application Priority Data

Jun. 25, 1992 (JP) ..... 4-191646

(51) Int. Cl.[7] ..... B41M 5/20; B41M 5/24

(52) U.S. Cl. ..... 503/201

(58) Field of Search ..... 503/201, 217, 503/208; 427/150–151

(56) References Cited

U.S. PATENT DOCUMENTS

| | | | | |
|---|---|---|---|---|
| 4,865,648 A | * | 9/1989 | Kito et al. | 427/151 |
| 5,178,669 A | * | 1/1993 | Watanabe et al. | 503/217 |
| 5,296,439 A | * | 3/1994 | Maruyama et al. | 503/201 |
| 5,395,433 A | * | 3/1995 | Maruyama et al. | 106/21 A |

FOREIGN PATENT DOCUMENTS

| | | |
|---|---|---|
| EP | 0 492 628 | 7/1992 |
| FR | 2 503 729 | 10/1982 |
| FR | 2 591 534 | 6/1987 |

* cited by examiner

*Primary Examiner*—B. Hamilton Hess
(74) *Attorney, Agent, or Firm*—Oblon, Spivak, McClelland, Maier & Neustadt, P.C.

(57) ABSTRACT

A method of reversible selective manifestation of different states of a functional element is disclosed. The functional element is composed of at least two compounds and is capable of alternatively assuming (a) a first state in which the two compounds interact to form a regular aggregate structure, or (b) a second state in which the two compounds do not interact, and at least one of the two compounds is in an aggregate or crystallized state. The respective conditions for attaining one of the two states can be reversibly and extremely speedily controlled, for instance, by use of a heat application device.

9 Claims, 15 Drawing Sheets

METHOD OF REVERSIBLE SELECTIVE MANIFESTATION OF DIFFERENT STATES OF FUNCTIONAL ELEMENT

BACKGROUND OF THE INVENTION

1. Field of the Invention

The present invention relates to a method of reversible selective manifestation of different states of a functional element, which comprises at least two compounds and is capable of alternatively assuming two different states, by controlling the respective conditions for attaining the two states.

2. Discussion of the Background

The utilization as a reversible functional element of a material capable of assuming a plurality of stable different states and being transferred among those different states as desired by the application of some stimuli thereto is conventionally known.

As such reversible functional elements, for instance, functional elements are known which utilize the reversible thermal transformation of a crystalline state, a molecular arrangement, or an aggregation state, such as a display element which utilizes the reversible changes in the molecular arrangement of liquid crystalline compounds by the application of an electric field or heat, and an information recording element which utilizes a reversible transformation between an amorphous state and a crystalline state of an inorganic compound or an organic compound, a reversible transformation between two different crystalline states, or a reversible transformation between two different association states of molecules.

Although some of these conventional elements are already widely used in practice, they leave much room for improvement because of the complexity of the structure thereof, the complexity of systems using the elements, and the poor contrast of displayed or recorded images.

There are also known functional elements which utilize reversible changes in molecular structure, such as photochromism and electrochromism. Almost none of such elements is used in practice because they have problems related to repeated operation performance and response speed.

A reversible functional element which utilizes a reversible reaction between two compounds has also been proposed. An example of such a reversible functional element which has been put to practical use is a thermosensitive coloring element which utilizes a coloring reaction between an electron-donor coloring compound and an electron-acceptor compound. The function of this thermosensitive coloring element can be manifested by the application of heat thereto, so that it assumes a colored state. Further, depending on the materials employed in the coloring element, it is possible to reversibly change its state from the colored state to a decolorized state.

Reversible thermosensitive coloring elements of this type, however, have the following shortcomings: A long time is required to return to a decolorized state from a colored state. A decolorizing agent is necessary. An additional treatment using an organic solvent or water is also necessary. Furthermore, once the reversible thermosensitive coloring element has been colored, it reassumes the initial decolorized state only with great difficulty.

SUMMARY OF THE INVENTION

Accordingly, an object of the present invention is to provide a method of reversibly and selectively manifesting different states of a functional element easily and speedily, free from the above-mentioned conventional shortcomings.

The above-mentioned object of the present invention can be achieved by a method of reversible selective manifestation of different states of a functional element, which comprises at least two compounds and is capable of alternatively assuming (a) a first state in which the two compounds interact to form a regular aggregate structure, or (b) a second state in which the two compounds do not interact, and at least one of the two compounds is in an aggregate or crystallized state, by controlling the respective conditions for attaining one of the two states.

BRIEF DESCRIPTION OF THE DRAWINGS

A more complete appreciation of the present invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
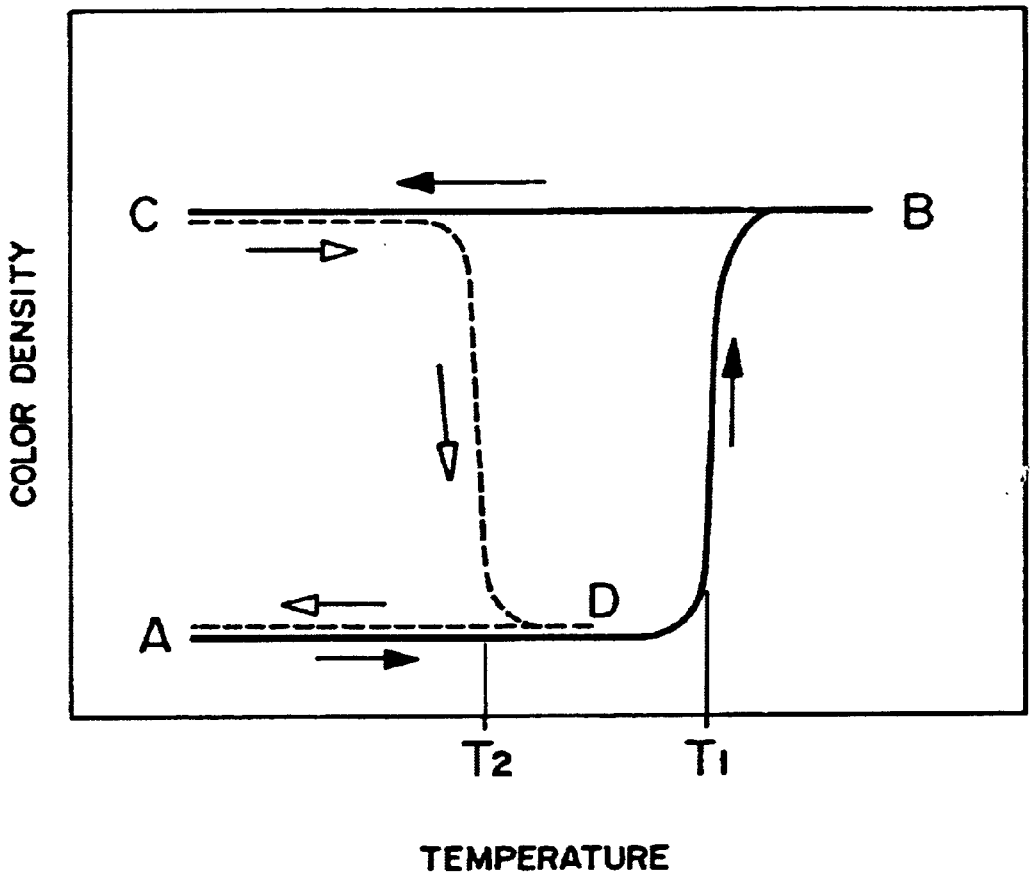
FIG. 1 is a diagram showing the relationship between the color development and decolorization of a functional element for use in the present invention and the temperature thereof.

The inventors of the present invention have analyzed the relationship among the molecular structure in the solid phase of each of two compounds, the strength of interaction therebetween, and the aggregate state thereof.

As a result, the inventors have discovered that the two compounds can assume a stable regular aggregation structure, even though the interaction therebetween is not very strong and the two compounds are solidified in the interacting state with difficulty, and that the two compounds can be brought back to the initial state without the interaction therebetween by destroying the regular aggregate structure.

In addition to the above, the inventors of the present invention have discovered that the formation of the above-mentioned regular aggregate structure can be controlled by selecting the molecular structure of a compound employed in a functional element, and that the aggregation force of a long chain structure such as a straight hydrocarbon chain plays a particularly important role.

The present invention has been made based on the above discoveries, and is directed to a method of reversibly and selectively manifesting different states of a functional element. This functional element comprises at least two compounds and is capable of alternatively assuming (a) a first state in which the two compounds interact to form a regular aggregate structure, or (b) a second state in which the two compounds do not interact, and at least one of the two compounds is in an aggregate or crystallized state. The above method is actually carried out by controlling the respective conditions for attaining one of the two states.

The above first state is attained by fusing the two compounds with the application of heat thereto, followed by rapidly cooling the two fused compounds. The interacting state of the two compounds can be stably maintained by the formation of the aggregate structure in the first state.

Moreover, the second state is attained by elevating the temperature of the functional element to a temperature below the temperature at which the two compounds are fused, thereby destroying the regular aggregate structure of the two compounds, and placing at least one of the two compounds in an aggregate or crystallized state.

The method of reversibly and selectively manifesting different states of the functional element according to the present invention utilizes the differences in the properties between the first state obtained by the interaction of the two compounds and the second state without the interaction.

In the above-mentioned first state, the two compounds are weakly bonded by the interaction therebetween. Such a bonded state can be seen in composite materials formed by hydrogen bonding, by charge-transportation-type interaction, or by coordination.

If a regular aggregate structure is formed when the two compounds are fused and then rapidly cooled, the interaction between the two compounds can be stably maintained at room temperature even though the interaction therebetween is weak, whereby the first state is formed.

On the other hand, when the fused compounds are gradually cooled, the aggregate structure of the two compounds is not generally formed by the interaction therebetween because the aggregation force which works among compounds of one kind is stronger than the aggregation force which works among two kinds of compounds, so that at least one of the two compounds forms a stable aggregate or crystallized state by the aggregation force among the molecules of the one kind of compound, without the aggregation force among the two kinds of compounds.

Therefore, when the regular aggregate structure of the two compounds is destroyed by the elevation of the temperature thereof, the aggregation force of the same kind of compounds predominates, so that a state free from the interaction between the two compounds can be regained.

The method of reversible selective manifestation of different states of the functional element according to the present invention can be applied to a functional element such as the previously mentioned composite material with relatively weak interaction.

The method of reversible selective manifestation of different states of the functional element according to the present invention comprises the steps of reversibly alternating the two states of the functional element by thermally controlling the relationship among the strength of the interaction between the two kinds of compounds, the aggregation force of the composite material formed by the interaction between the two kinds of compounds, and the aggregation force between the molecules of the same kind of compounds.

The state in which the regular aggregate structure of the two compounds is maintained is attained by the aggregation force of the composite material of the two compounds. In this aggregation force is inherently contained the aggregation force which works between the compounds of the same kind.

In this sense, it is preferable that at least one of the two compounds have such a structure that a relatively strong aggregation force is generated and a regular aggregate structure is apt to be formed. Such a structure is obtained, for example, by bonding a long higher aliphatic chain such as a long hydrocarbon chain to at least one of the two compounds. Such a long chain structure has various advantages because the aggregation force can be controlled in accordance with the length of the aliphatic chain in the long chain structure. For example, the temperature for the destruction of the aggregate structure of the composite material formed by the interaction of the two compounds can be controlled by the selection of the length of the aliphatic chain. Furthermore, a portion which exhibits the function of the compound and a portion which exhibits the aggregation force and aggregate properties of the compound can be separately designed within the molecule of the compound. Furthermore, the length of the long chain structure necessary for the portion assigned for the exhibition of the function of the compound can be easily determined, so that the different states of the functional element can be reversibly manifested without difficulty.

The differences between the state in which the two compounds are interactive and the state in which the two compounds are not interactive in the functional element for use in the present invention are exhibited, for example, in the following differences in properties: optical properties such as light absorption, optical transmittance, scattering, and reflection; crystaloptical properties such as double refraction and polarized light properties; nonlinear optical properties such as secondary higher harmonics (SHG) properties; electrical properties such as electrical conductance, electrical resistivity, electron mobility, positive-hole mobility, dielectric constant, ferroelectric properties, piezoelectric characteristics, pyro-electric properties, and chargeability; thermal properties such as thermal conductivity; magnetic properties; mechanical properties; and surface characteristics such as wetting properties.

The present invention can provide a method of reversible thermal manifestation of the above-mentioned properties.

In order to explain the method of the present invention more specifically, a thermal coloring functional element is employed as an example of the functional element in the present invention. The thermal coloring functional element comprises an electron-donor coloring compound (hereinafter referred to as the coloring agent) and an electron-acceptor compound (hereinafter referred to as the color developer). This thermal coloring functional element can assume a color development state in which the coloring agent and the color developer interact to produce a colored composite material with a regular aggregate structure, and a decolorized state in which the regular aggregation structure of the colored composite material is decomposed, so that the coloring agent and/or the color developer are in an aggregate or crystallized state.

When the coloring agent and the color developer are fused with the application of heat thereto, the molecules of the coloring agent and the color developer come into contact with each other and interact even though the interaction is partial. As a result, the functional element assumes the color development state in its entirety. In this case, the ratio of the interacting molecules may differ depending upon the combination of the coloring agent and the color developer.

When the fused mixture of the coloring agent and the color developer in the color development state is gradually cooled, the interaction between the coloring agent and the color developer is lost during this cooling course, and the color developer is separately crystallized, so that the functional element is decolorized. This is because, during the above-mentioned cooling course, the aggregation force of the color developer itself is stronger than the interaction between the coloring agent and the color developer.

On the other hand, when the fused mixture of the coloring agent and the color developer in the color development state is rapidly cooled, the functional element continues to assume the color development state. This is because when cooled rapidly, the interaction between the coloring agent and the color developer is maintained, so that the colored composite material with the regular aggregate structure is formed by the maintained interaction between the coloring agent and the color developer.

In the above-mentioned color development state with the formation of the regular aggregate structure, obtained by rapid cooling, the percentage of the molecules of the coloring agent in the color development state is larger than that in the color development state obtained by fusing the coloring agent and the color developer.

This is because the formation of the regular aggregate structure provides a state in which the coloring agent and the color developer interact more easily than in the case where the coloring agent and the color developer are fused.

The state in which the regular aggregate structure is formed with the interaction between the coloring agent and the color developer can exist stably at room temperature. However, in this state, the binding force between the coloring agent and the color developer is weak, so that when the functional element in the above-mentioned state is heated to a temperature below the temperature at which the color developer and the coloring agent are fused, the regular aggregate structure in the functional element is destroyed with the solid phase being maintained, so that the stability attained by the regular aggregate structure is lost. The result is that the color developer is dissociated from the coloring agent, whereby the color developer is independently aggregated or crystallized. Thus, the functional element assumes the decolorized state without the interaction between the color developer and the coloring agent.

In addition, the above state without the interaction between the coloring agent and the color developer, obtained by the above-mentioned heating, can be stably maintained even when this functional element is cooled to room temperature.

The reversible manifestation of the function of the above-mentioned thermal coloring functional element for use in the present invention will now be explained with reference to FIG. 1.

FIG. 1 is a diagram showing the relationship between the color density obtained by the thermal coloring functional element and the temperature thereof, with the color density as ordinate and the temperature as abscissa.

In FIG. 1, reference symbol A indicates a decolorized state of the functional element at room temperature, reference symbol B indicates a color development state of the functional element in a fused state by the application of heat thereto, and reference symbol C indicates a color development state of the functional element at room temperature.

The functional element for use in the present invention is assumed to be in the above-mentioned decolorization state A at the beginning. When the temperature of the functional element in this state is raised and reaches temperature $T_1$, the color density of the element begins to increase since the coloring agent and the color developer begin to be mixed and fused with the formation of a eutectic mixture at the temperature $T_1$. As the temperature of the functional element is further increased, the color density of the element increases and finally the element reaches the color development state B. Even though the temperature of the element in the state B is decreased to room temperature, the color of the element is not changed, and is in the state C which is the same as the color development state B. The process from the decolorized state to the color development state as explained above is indicated by the solid line in the direction of the arrow (→) in FIG. 1.

When the temperature of the functional element in the state C is again raised, the color density begins to decrease at temperature $T_2$ and the functional element finally reaches a state D which is a completely decolorized state. When the temperature of the functional element in the state D is decreased, the decolorized state of the functional element is maintained, so that the element returns to the initial state A. The process from the color development state to the decolorized state as explained above is indicated by the broken line in the direction of the arrow (→) in FIG. 1.

Thus, in FIG. 1, the temperature $T_1$ is the color development initiation temperature at which the color development is initiated, and the temperature $T_2$ is the decolorization initiation temperature at which the decolorization is initiated. The temperature range from $T_2$ to $T_1$ is a decolorization temperature range in which the functional element assumes a decolorized state.

The color development and decolorization phenomenon of the functional element for use in the present invention shown in FIG. 1 is characterized in that the above-mentioned decolorization temperature range is located in a zone lower than the color development initiation temperature at which the fusing of the functional element is initiated and a coloring reaction is initiated in the functional element. Therefore, the functional element in the color development state at room temperature can be decolorized when heated to a temperature within the decolorization temperature range.

In addition, such a color development and decolorization phenomenon can be repeatedly caused to occur in the functional element.

FIG. 1 shows a representative example of the process of color development and decolorization of a thermal coloring functional element for use in the present invention. The color development initiation temperature and the decolorization initiation temperature vary, depending upon the combination of the coloring agent and color developer employed. The color density in the state B is not always the same as that in the state C. In some cases, the respective color densities are different.

In order to obtain a thermal coloring functional element comprising a color developer and a coloring agent in a color development state at room temperature, the color developer and the coloring agent in the thermal coloring functional element are fused by the application of heat thereto, and then rapidly cooled.

Furthermore, in order to obtain the decolorized state at room temperature, using the above-mentioned thermal coloring functional element, the thermal coloring functional element in the color development state is heated to a decolorization temperature which is lower than the color development temperature, and then decreasing the temperature thereof to room temperature.

A conventional functional element with poor reversibility or without reversibility used as a thermosensitive material comprising a coloring agent and a color developer is not readily decolorized even when the temperature of the functional element in the color development state is increased.

A number of functional elements comprising various coloring agents and color developers capable of inducing colors in the coloring agents were tested with respect to the changes in color development states thereof, by fusing the coloring agents and color developers, and then decreasing the temperature of each of the fused mixtures thereof.

The result was that not all functional elements can maintain the color development states thereof, and some are decolorized as the temperature is decreased. Moreover, the above-mentioned phenomenon varies greatly, depending upon the conditions for decreasing the temperature of the functional element.

The inventors of the present invention made comparative tests with respect to the color development state maintaining properties of functional elements which include one color developer selected from the group consisting of (a) a color developer employed in a conventional thermosensitive material, (b) a color developer with an aliphatic chain which is bonded to a moiety of the color developer which exhibits a color-inducing function, and (c) a color developer with the color developing capability thereof being changed, when the temperature of each functional element in the color development state was decreased.

In the above comparative tests, the temperature of each functional element was decreased under the following two different conditions: Under the first condition, the temperature of the functional element was gradually decreased at a cooling rate of about 5° C./min or less (hereinafter referred to as gradual cooling), and under the second condition, the temperature was rapidly decreased at a cooling rate of about 50° C./sec or more (hereinafter referred to as rapid cooling).

In practice, gradual cooling was carried out by interposing the functional element between a pair of glass plates, fusing the functional element, using a heater, and allowing the fused functional element to cool by turning off the heater or by suspending the heated functional element in air.

Rapid cooling was carried out by immersing the heated functional element in cold water.

When the functional element is cooled at a cooling rate intermediate between the gradual cooling rate and the rapid cooling rate, it is possible that portions in the state obtained by gradual cooling and portions in the state obtained by rapid cooling become mixed in the functional element, or an intermediate state between the state obtained by gradual cooling and the state obtained by rapid cooling is formed in the functional element.

When the functional element is heated by a thermal head which is conventionally used for thermosensitive recording, the functional element is rapidly heated, and accordingly rapidly cooled, so that rapid cooling is carried out.

Moreover, the functional element was heated and then cooled, and the structure of the cooled functional element was analyzed by x-ray diffraction.

The functional elements are classified into A1, A2 and B types as shown in TABLE 1 in accordance with the properties and the structure thereof, based on the results of the above analysis using x-ray diffraction.

TABLE 1

| When gradually cooled from fused color development state | When rapidly cooled from fused color development state | Structure of functional element after rapid cooling | Type of functional element |
|---|---|---|---|
| Color development state formed | Color development state formed | Amorphous state | A1 |
| | | Regular aggregate structure | A2 |
| Mostly decolorized, without the formation of color development state | Color development state formed | Regular aggregate structure | B |

The results shown in TABLE 1 indicate that when the heated and fused functional elements in the color development state are gradually cooled to room temperature, some functional elements assume the color development state, while other functional elements do not assume the color development state, but are mostly decolorized.

In contrast, when the heated and fused functional elements in the color development state are rapidly cooled to room temperature, all the functional elements assume the color development state.

Furthermore, some functional elements can, for an extended period of time, stably maintain the color development state, which is obtained by gradually or rapidly cooling the heated and fused functional elements in the color development state. Other functional elements cannot maintain the color development state, but are gradually decolorized with time.

An x-ray analysis was conducted on the functional elements which were decolorized when gradually cooled from the fused state, during the course of the decolorization. The analysis indicated that the above-mentioned decolorization is caused to take place by the crystallization and separation of the color developer in the functional element. This also applies to the functional elements which are gradually decolorized with time.

The functional element type B in TABLE 1 cannot assume the color development state and is mostly decolorized when gradually cooled, but can assume the color development state when rapidly cooled.

An x-ray diffraction analysis indicated that the functional element type B has such a structure that the colored composite material formed therein assumes a regular aggregate structure after rapid cooling.

From the above results, it is considered that in the functional element which cannot assume a color development state by gradual cooling, which is the functional element type B in TABLE 1, the interaction between the coloring agent and the color developer which constitute the functional element is relatively weak, so that the aggregation force among the molecules of the color developer predominates at a lower temperature than the eutectic temperature of the coloring agent and the color developer, when gradually cooled from the fused color development state. As a result, the color developer is caused to separate from the colored composite material and is crystallized. Therefore, the functional element type B is decolorized when cooled gradually.

On the other hand, when the functional element type B is rapidly cooled, the colored composite material forms a regular aggregate structure and the bond between the color developer and the coloring agent is stabilized. Thus the functional element type B assumes the color development state when rapidly cooled.

In other words, a decolorized state can be obtained in the functional element type B by destroying the regular aggregate structure of the colored composite material formed therein by elevating the temperature of the functional element to bring about the thermal movement of the molecules of the colored composite material, and by causing the color developer to be independently recrystallized, separated from the colored composite material.

The functional elements of the other types A1 and A2 in TABLE 1 will now be explained in comparison with the functional element type B.

As mentioned above, the functional element type B assumes the color development state only when the regular aggregate structure of the colored composite material is formed by rapid cooling from a fused color development state of the functional element. In the functional element type B, the bond strength between the color developer and the coloring agent is rather high, and the aggregation force which works within the colored material is also very high.

Unless the bond strength between the coloring agent and the color developer is rather high, the color development state of the functional element cannot be maintained by the formation of the aggregate structure of the colored composite material when the functional element is rapidly cooled.

When the temperature of the functional element type B which assumes the color development state by rapid cooling is elevated, the aggregate structure and the color development state thereof can be maintained at a certain temperature. Once the temperature of the functional element type B exceeds the temperature, the aggregate structure of the colored composite material is destroyed, and the color developer is independently crystallized, because the color developer can exist as independent crystals at the temperature, so that the functional element type B is immediately decolorized. In this case, decolorization is rapid since the aggregation force among the molecules of the color developer is strong.

On the other hand, the functional elements types A1 and A2 assume a color development state when cooled either gradually or rapidly from a fused color development state. The functional element type A1 in the color development state after rapid cooling is a colored composite material of an amorphous aggregate structure, while the functional element type A2 in the color development state after rapid cooling is a colored composite material of a regular aggregate structure. In the functional element type A1 with the amorphous aggregate structure, the bond strength between the coloring agent and color developer is high, and the aggregation strength within the colored composite material is weak.

A functional element which belongs to the type A1 includes a color developer with a relatively strong aggregation force. Such a functional element tends to be decolorized because of the crystallization and separation of the color developer with time, even though the functional element is in an amorphous state after gradual cooling or rapid cooling.

In the functional element type A2 which forms a regular aggregate of the colored composite material when rapidly cooled, the aggregation force of the colored composite material is strong. However, the bond strength between the color developer and the coloring agent is stronger than the aggregation force of the colored composite material, so that even though the aggregate structure of the colored composite material is destroyed by elevating the temperature, the colored composite material can be maintained, or the regular aggregate structure can be maintained up to high temperatures.

The destruction of the aggregate structure is a transitional stage leading to a fused color development state, but does not lead to decolorization.

Among the functional elements of type A2, there are elements which do not assume a complete decolorization state. In such functional elements, even when the aggregate structure is destroyed with the elevation of the temperature, since the aggregation force of the color developer is so weak at that temperature, the crystallization of the color developer is insufficient for decolorization, or the coloring agent is incorporated into the aggregation structure of the color developer (for instance, in a liquid crystal structure). In the former case, no substantial decolorization takes place even when the temperature is raised from a rapidly cooled color development state. In the latter case, decolorization takes place to some extent by the destruction of the aggregate structure, so that the element can be used as a reversible functional element. However, the scope of application is quite limited because the decolorization does not take place so completely as in the case of the above-mentioned functional element type B.

As explained above, the decolorization phenomenon of the functional element is affected by the relationship among the bond strength between the color developer and the coloring agent, the aggregation force within the colored composite material, and the aggregation force within the color developer.

It is difficult to quantitatively show the above-mentioned relationship, but a functional element useful in the present invention is a functional element that has characteristics by which a color development state cannot be formed by gradual cooling, but can be formed by rapid cooling, from a fused color development state, with the formation of the regular aggregate structure of the colored composite material. In other words, if a functional element has the above-mentioned characteristics, the element has an excellent reversible thermosensitive coloring performance.

Such an excellent functional element can readily assume a decolorized state when heated to a decolorization initiation temperature lower than the temperature at which a fused color development state is obtained, with the destruction of a regular aggregate structure of a colored composite material, and with the separate crystallization of the color developer with the predominant aggregation force of the color developer.

The conditions for rapid cooling and the conditions for gradual cooling differ, depending upon the combination of the coloring agent and color developer employed in the functional element.

It is difficult to make exact distinctions between the two, but as mentioned previously, rapid cooling is conducted at a cooling rate of about 50° C./sec or more, and gradual cooling is conducted at a cooling rate of about 5° C./min or less.

In the present invention, it can be said that the conditions for rapid cooling are those which bring about a state in which two compounds interact to form a regular aggregate structure, and the conditions for gradual cooling are those which bring about a state in which at least one of the two compounds is separately crystallized or aggregated.

The method of reversible selective manifestation of different states of the functional element according to the present invention will now be explained in more detail.

By way of example, reversible coloring functional elements for use in the present invention were fabricated, each comprising a coloring agent and a representative color developer with a long chain structure with a different number of carbon atoms, capable of inducing color in the coloring agent, in order to investigate the relationship among the length of the long chain structure of the color developer, the formation of the color development state, and the aggregate structure of the functional element.

A mixture of a phosphonic acid with a saturated hydrocarbon chain (straight alkyl group) serving as the above-mentioned color developer and 2-(o-chloroanilino)-6-dibutylaminofluoran (hereinafter referred to as D1) serving as the above-mentioned coloring agent, with the respective molar ratios thereof being 5:1, was interposed between a pair of glass plates and heated to 175° C. to fuse the mixture.

The heated mixture assumed a color development state, whereby the above-mentioned functional elements in the color development state were fabricated.

In the reversible coloring functional elements in which a phosphonic acid with a straight chain alkyl group having 14 to 22 carbon atoms (hereinafter referred to as P14 to P22) was employed as the color developer, when the temperature thereof was gradually decreased from 175° C. with a cooling rate of 4° C./min, these functional elements mostly assumed a decolorization state.

When each of the above reversible coloring functional elements was rapidly cooled from 175° C. to room temperature, the functional element assumed a color development state.

In the case of a reversible coloring functional element employing as the color developer a phosphonic acid with a straight chain alkyl group having 12 carbon atoms (hereinafter referred to as P12), the functional element assumed a color development state when rapidly cooled. However, when the ambient temperature was high, the decolorization proceeded with time in the reversible coloring functional element.

In the case of a reversible coloring functional element employing as the color developer a phosphonic acid with a straight chain alkyl group having 10 carbon atoms (hereinafter referred to as P10), the functional element assumed a color development state either when gradually cooled or when rapidly cooled, but this color development state was not stably maintained, and the decolorization proceeded with time in the reversible coloring functional element.

In the case of a reversible coloring functional element employing as the color developer a phosphonic acid with a straight chain alkyl group having 4 carbon atoms (hereinafter referred to as P4), the functional element assumed a color development state either when gradually cooled or when rapidly cooled, and the thus obtained color development state was stably maintained. However, when the ambient temperature was high, the decolorization proceeded with time in the reversible coloring functional element.

Figure 2:
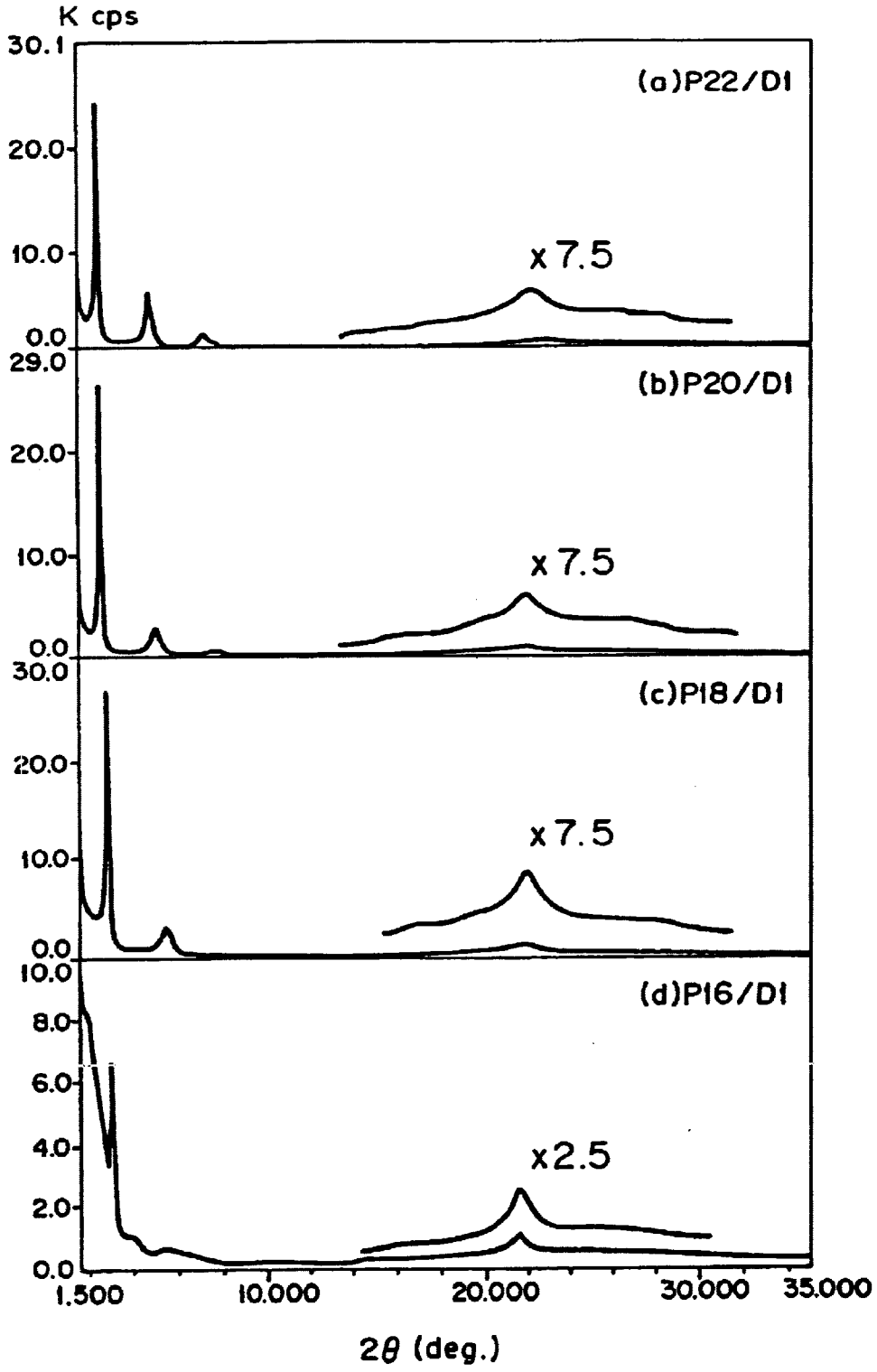
FIGS. 2 and 3 are charts showing the changes in the x-ray diffraction of functional elements when rapidly cooled from the respective fused color development states.
Figure 3:
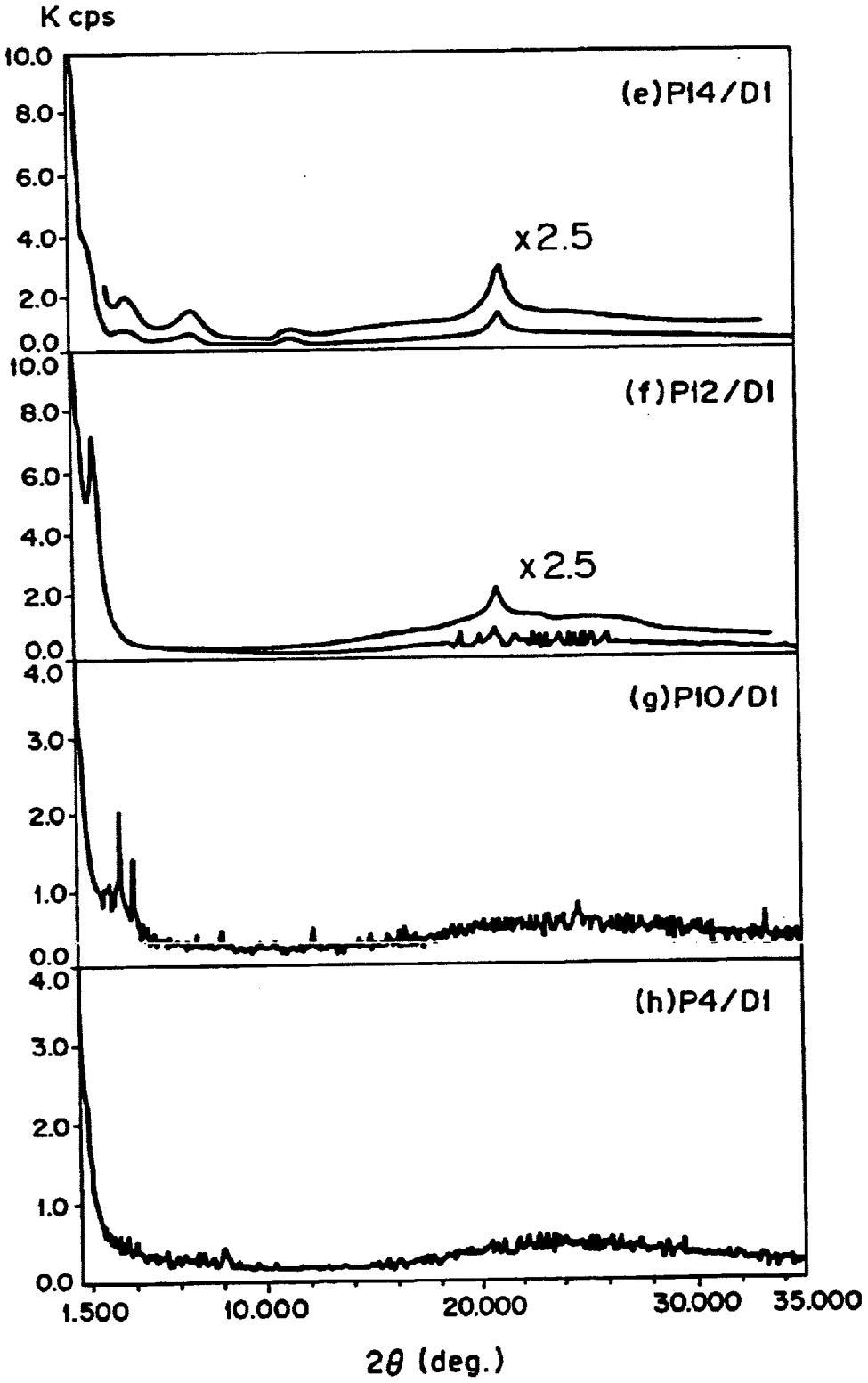

FIGS. 2 and 3 show x-ray diffraction patterns of the functional elements comprising as the color developer, any of P22, P20, P18, P16, P14, P12, P10, and P4; and as the coloring agent, D1.

The x-ray diffraction patterns (a) to (f) of P22 to P12 in FIGS. 2 and 3 show the respective diffraction peaks which indicate the regular aggregate structure of each colored composite material. More specifically, peaks with a diffraction angle of 10° or less are observed at a lower angle side, which indicate a layered structure of the colored composite material. Peaks with a diffraction angle of 20-21° are also observed, which indicate the aggregation of the alkyl chain, in each diffraction pattern of (a) to (d) in FIG. 2 and (e) and (f) in FIG. 3.

In contrast, in the x-ray diffraction pattern (g) in FIG. 3 of the functional element comprising P10, peaks indicating the aggregate structure of the colored composite material are not observed. Instead, a peak which indicates the individual crystallization of P10 is observed. This indicates that separation and crystallization of P10 has proceeded during the x-ray diffraction measurement. This peak in the diffraction pattern (g) increases with time.

In the x-ray diffraction pattern (h) in FIG. 3 of the functional element comprising P4, no peaks are observed and the functional element is in an amorphous state.

The functional element comprising P4 and the functional element comprising P10 becomes tar-like after rapid cooling. The other functional elements become like a hard film after rapid cooling, and the longer the alkyl chain of the color developer, the greater the hardness thereof.

The functional elements each comprising P14 to P22 cannot assume a color development state when gradually cooled from the fused color development state, but can maintain a color development state when rapidly cooled, with the formation of a regular aggregate structure of the respective colored composite materials. Therefore these functional elements are classified as the previously mentioned type B in TABLE 1.

The functional element comprising P10 is also classified as the type A1, because this element assumes a color development state either by gradual cooling or by rapid cooling, and the crystals of P10 separate out with time, so that the functional element is decolorized. The colored composite material is in an amorphous form.

The functional element comprising P4 is also classified as the type A1, which assumes a color development state either by gradual cooling or by rapid cooling, and the colored composite material is in an amorphous form.

Figure 4:
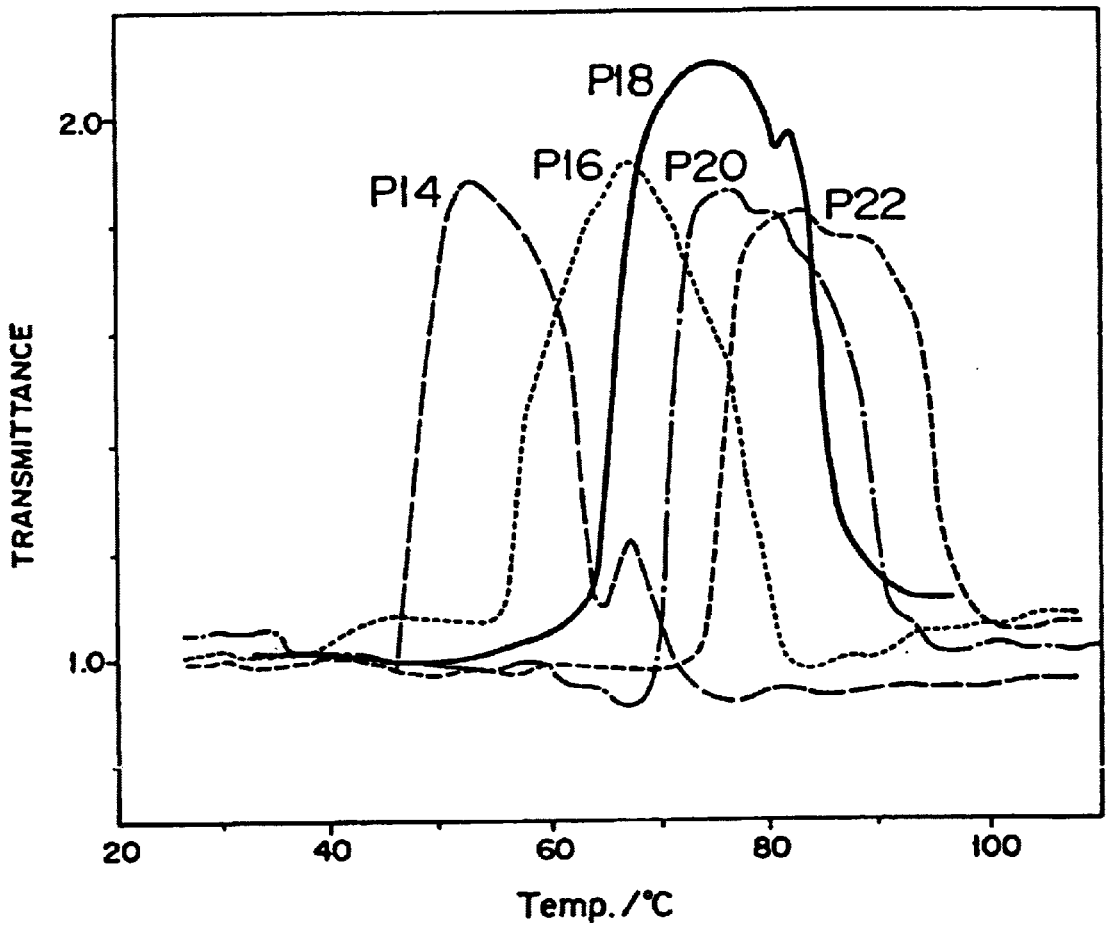
FIG. 4 is a chart showing the changes in the transmittance of functional elements when the temperature thereof was raised from the respective color development states obtained by rapid cooling.

FIG. 4 shows the changes in the light transmittance in each of the functional elements which belong to the type B, comprising P14 to P22, as the temperature of the functional elements in the color development state, obtained by rapidly cooling the fused element, is elevated at a rate of 4° C./min.

As can be seen from FIG. 4, the transmittance of each element begins to increase at a respective certain temperature, and each element is decolorized at this temperature. This is the decolorization initiation temperature. The decolorization initiation temperature of each functional element changes, depending upon the length of the alkyl chain therein. The longer the alkyl chain, the higher the decolorization initiation temperature.

The changes of the aggregate structure of each functional element during the course of the elevation of the temperature thereof have been examined by use of x-ray diffraction.

Figure 5A:
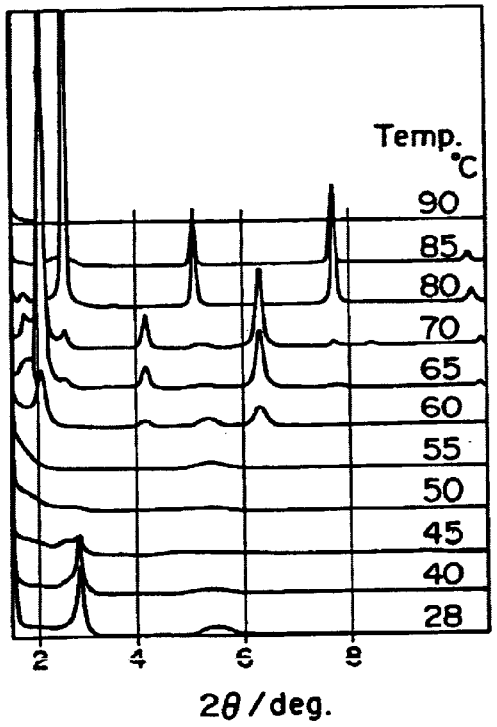
FIGS. 5(*a*), 5(*b*), 6(*a*) and 6(*b*) are charts showing the changes in the x-ray diffraction of functional elements when the temperature thereof was raised from the respective color development states obtained by rapid cooling.
Figure 5B:
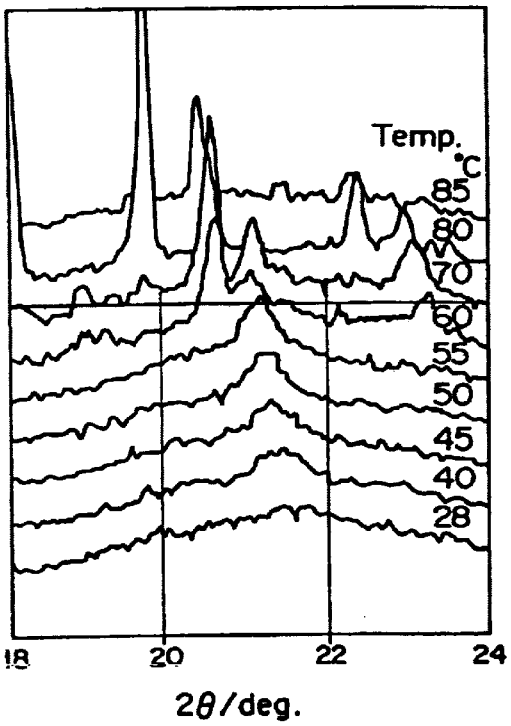

FIG. 5(*a*) and FIG. 5(*b*) respectively show the changes in the x-ray diffraction of the functional element comprising P18 on a lower diffraction angle side, and the changes in the x-ray diffraction of the functional element comprising P18 on a higher diffraction angle side.

Figure 6A:
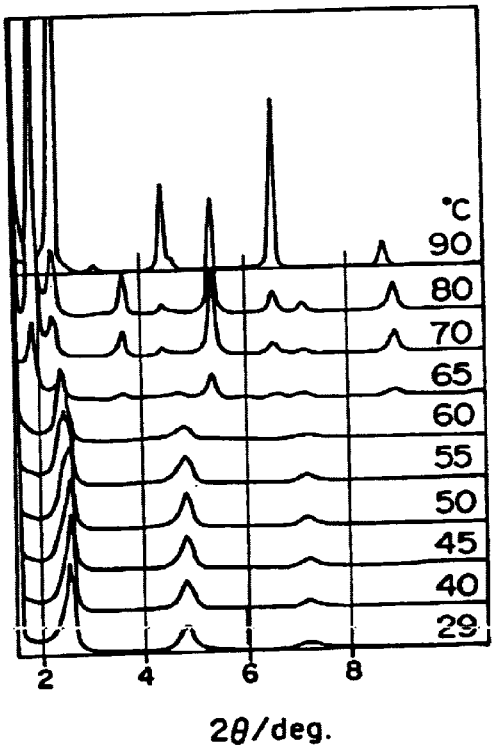
Figure 6B:
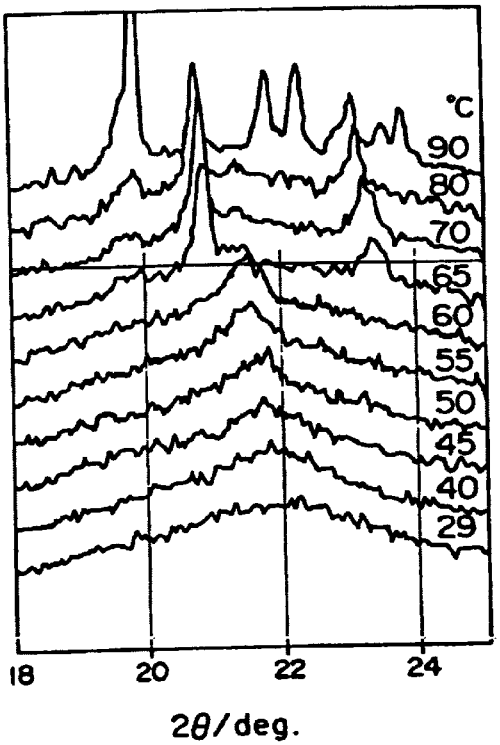

FIGS. 6(*a*) and 6(*b*) respectively show the changes in the x-ray diffraction of the functional element comprising P22 on a lower diffraction angle side, and the changes in the x-ray diffraction of the functional element comprising P22 on a higher diffraction angle side.

In both the above-mentioned functional elements, the peaks indicating the layered structure on the lower diffraction angle side are decreased as the temperature of the functional element is increased, while the peaks which indicate the aggregate structure of the alkyl chain are increased as the temperature of the functional element is increased.

The peaks indicating the aggregate structure of the colored composite material disappear near the decolorization initiation temperature, and the peaks which indicate that individual crystallization of the color developers P18 and P22 appear instead. The functional elements are thus decolorized.

Similar changes in the x-ray diffraction pattern are also observed in all the functional elements comprising P14 to P22 and other functional elements classified as the type B. Therefore, it can be seen that a functional element classified as the type B, which cannot form a color development state by gradual cooling from a fused color development state, but can form a color development state by rapid cooling from a fused color development state to form a regular aggregate structure of a colored composite material, can be decolorized by the destruction of the aggregate structure by the elevation of the temperature thereof and the separate crystallization of the color developer.

In particular, the destruction of the aggregate structure and the crystallization of the color developer can be considered to correspond to the fusion of the long chain structure portion and the rearrangement thereof.

Such a system that cuts the bond between the color developer and the coloring agent in the functional element in the above-mentioned manner is completely novel.

The functional element comprising P4 as a color developer can stably maintain the color development state although the element is in an amorphous state. In this sense, this functional element is similar to a functional element which employs a conventional thermosensitive material without reversibility or with poor reversibility, comprising such a color developer as 2,2'-bis(p-hydroxyphenyl) propane.

These elements belong to the previously mentioned type A1 in TABLE 1. So long as such elements are in a color development state, a sudden decolorization does not occur even when the temperature thereof is increased.

A functional element comprising octadecylphosphonic acid (hereinafter referred to as P18) as a color developer, and 2-anilino-3-methyl-6-dietylaminofluoran as a coloring agent (hereinafter referred to as D2) has been examined. This functional element can maintain a color development state, which is obtained either by gradual cooling or by rapid cooling from a fused color development state.

Figure 7:
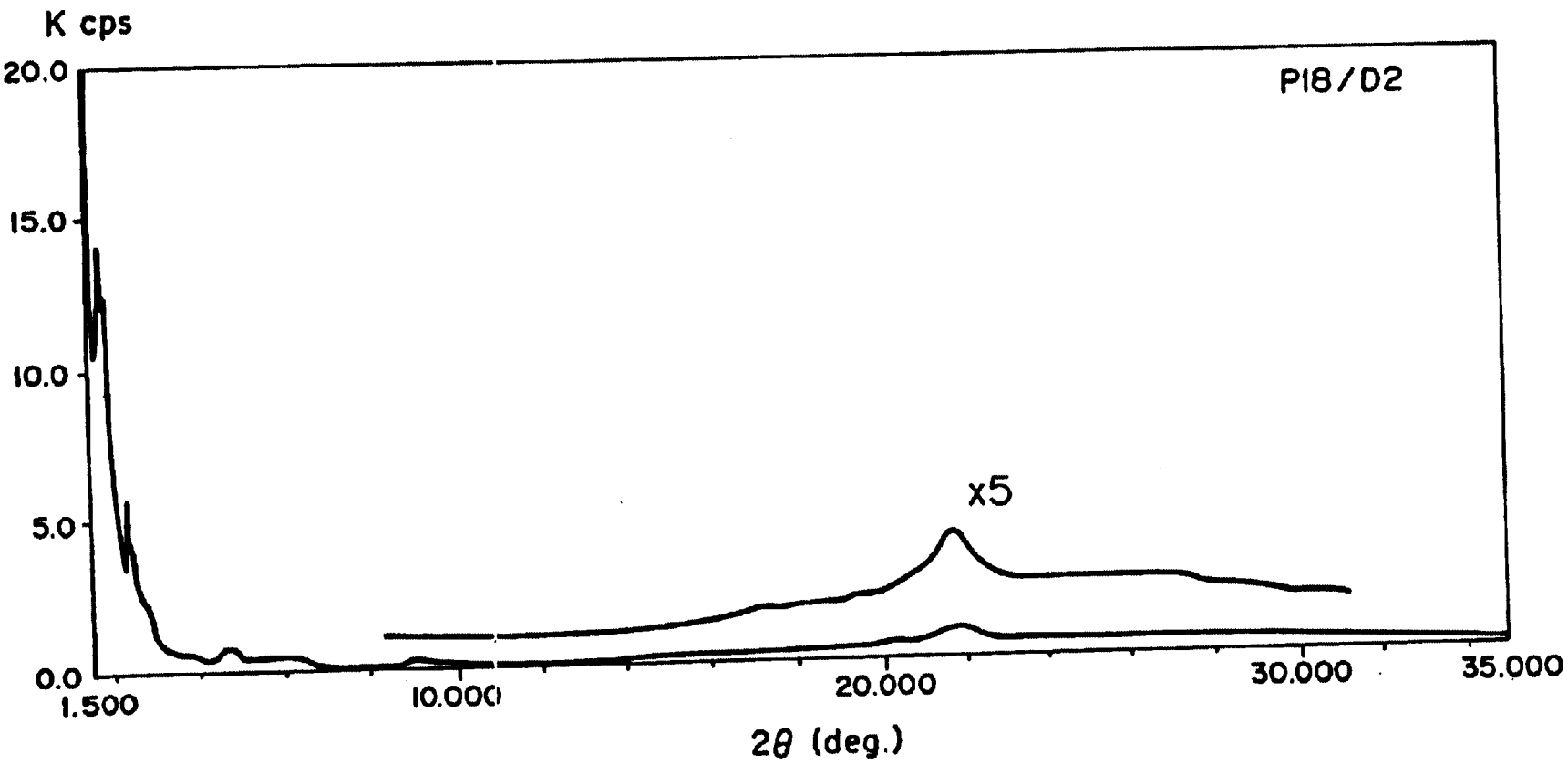
FIGS. 7 and 8 are charts showing the changes in the x-ray diffraction of comparative functional elements when rapidly cooled from the respective color development states obtained by rapid cooling.

FIG. 7 shows an x-ray diffraction pattern of the above-mentioned functional element in the color development state obtained by rapid cooling, which indicates a regular aggregate structure of the colored composite material. Thus, this element is classified as the previously mentioned type A2 in TABLE 1. In this functional element, changes in the aggregate structure of the colored composite material are observed, but no decolorization takes place even when the temperature of the functional element in a color development state is increased.

A functional element comprising octadecyl gallate (hereinafter referred to as GE18) as a color developer and 2-(o-chloroanilino)-6-dibutylaminofluoran (referred to as D1) as a coloring agent assumes a color development state either when gradually cooled or when rapidly cooled, from a fused color development state.

Figure 8:
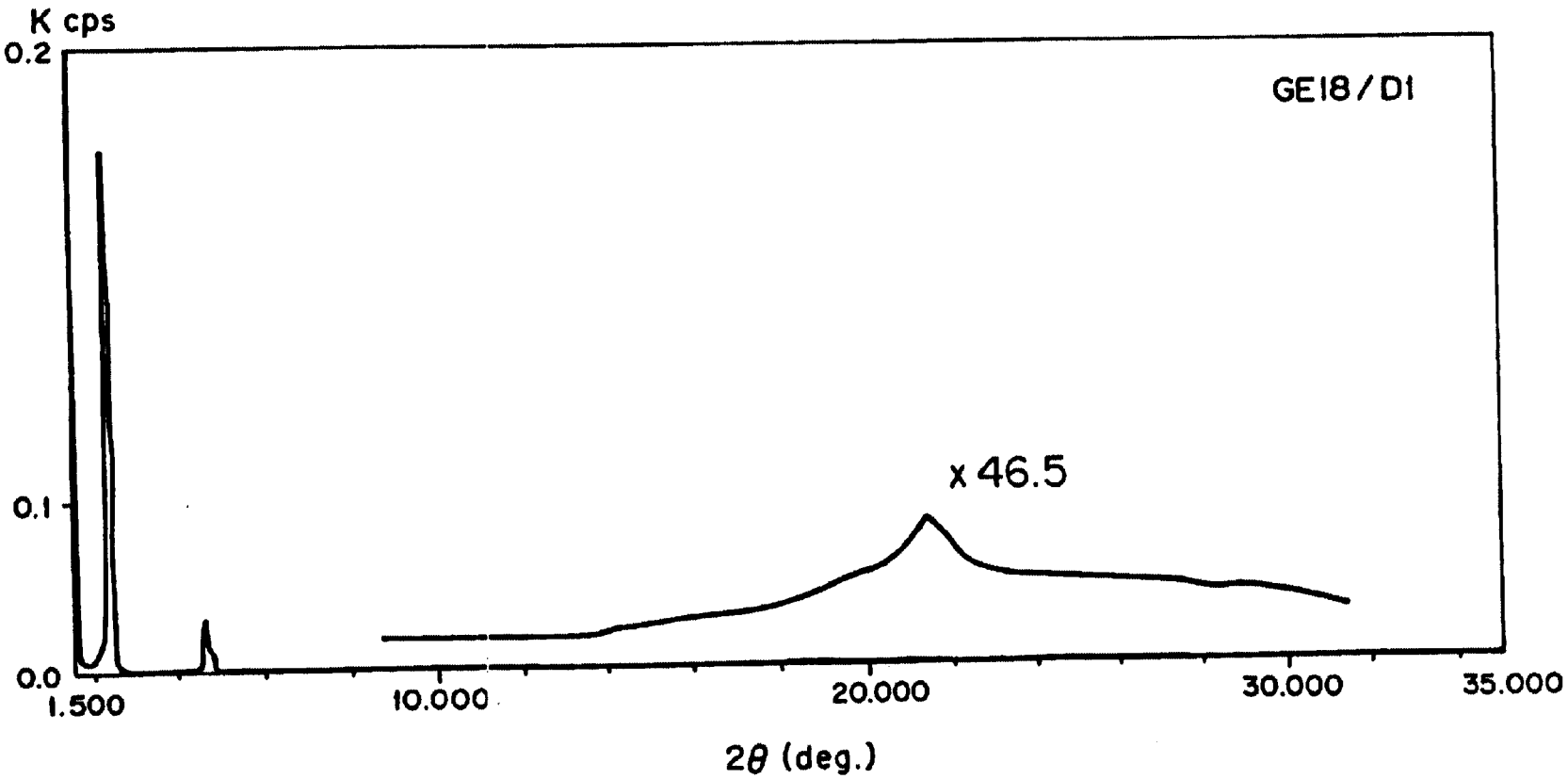

FIG. 8 is an x-ray diffraction chart showing the changes in the x-ray diffraction of the above-mentioned functional element, which indicates the formation of a regular aggregate structure of the colored composite material. This element is classified as the previously mentioned type A2 in TABLE 1.

When this functional element is caused to assume a color development state by rapid cooling, and the temperature thereof is elevated, the decolorization is caused to some extent at temperatures in the range of 45 to 50° C., with the destruction of the colored composite material, but no distinct crystallization of the color developer occurs. When the temperature of the functional element is further elevated, a strong peak appears in the x-ray diffraction chart, which is different from the peak indicating the aggregate structure of the colored composite material, together with the occurrence of another color development. The strong peak indicates that another aggregate structure of the colored composite material is formed, and the functional element assumes another color development state.

The functional element comprising P12 as a color developer and D1 as a coloring agent is decolorized to some extent when the temperature thereof is elevated to 40 to 45° C. However this decolorization is not so complete as in the functional element comprising P14 as a color developer and D1 as a coloring agent. When the functional element comprising P12 and D1 is further heated to 50° C. or more, the element assumes the color development state obtained based on the formation of the aggregate structure of the colored composite material again. These elements are not satisfactorily decolorized, unlike the elements classified as the type B, because the color developers used in these elements do not have satisfactory aggregation force, and these elements assume a stable color development state in a liquid crystal state when the temperature thereof is elevated.

A functional element suitable for use in the present invention does not assume a color development state when gradually cooled from a fused color development state, but assumes a color development state when rapidly cooled with the formation of a regular aggregate structure of a colored composite material.

The method of reversible selective manifestation of different states of a functional element according to the present invention comprises the above-mentioned transformation step in a reversible thermal coloring method using the above-mentioned functional element, with the destruction of a regular aggregate structure of a colored composite material of a color developer and a coloring agent, and the separate crystallization of the color developer.

Any color developer can be employed in the present invention as long as the color developer is capable of inducing color formation within the molecule of a coloring agent by the reaction with the color developer and can be crystallized, separated from a colored composite material formed in an aggregate structure by the reaction between the color developer and the coloring agent.

From the above-mentioned view point, it is preferable that the color developer have a long chain structure therein in order to control or enhance the aggregation force within the color developer.

More specifically, it is preferable that the color developer for use in the present invention have an aliphatic group with 12 or more carbon atoms as the long chain structure. When the aliphatic group have 12 or more carbon atoms, the color developer can have a sufficient aggregation force.

Examples of the aliphatic group include a straight-chain or branched chain alkyl group, and a straight-chain or branched chain alkenyl group. The aliphatic group may have a substituent such as halogen, an alkoxyl group, or an ester group.

Examples of the color developers for use in the present invention are as follows:

(A) organic phosphoric acid compounds such as an organic phosphoric acid compound represented by the following general formula (I):

$$R^1—PO(OH)_2 \quad (I)$$

wherein $R^1$ represents an aliphatic group having 12 or more carbon atoms.

Specific examples of the organic phosphoric acid compound represented by general formula (I) include dodecylphosphonic acid, tetradecylphosphonic acid, hexadecylphosphonic acid, octadecylphosphonic acid, eicosylphosphonic acid, docosylphosphonic acid, tetracosylphosphonic acid, hexacosylphosphonic acid, and octacosylphosphonic acid.

(B) Aliphatic carboxylic acid compounds (B-1) α-hydroxy aliphatic carboxylic acid compound represented by the following general formula (II):

$$R^2—CH(OH)—COOH \quad (II)$$

wherein $R^2$ represents an aliphatic group having 12 or more carbon atoms.

Specific examples of the α-hydroxy aliphatic carboxylic acid compound represented by general formula (II) are as follows: α-hydroxydodecanoic acid, α-hydroxytetradecanoic acid, α-hydroxyhexadecanoic acid, α-hydroxyoctadecanoic acid, α-hydroxypentadecanoic acid, α-hydroxyeicosanoic acid, α-hydroxydocosanoic acid, α-hydroxytetracosanoic acid, α-hydroxyhexacosanoic acid, and α-hydroxyoctacosanoic acid.

(B-2) Halogen-substituted compounds having an aliphatic group having 12 or more carbon atoms, with the halogen bonded to at least one carbon atom at α-position or β-position of the compounds can be preferably employed.

Specific examples of such halogen-substituted compounds are as follows: 2-bromohexadecanoic acid, 2-bromoheptadecanoic acid, 2-bromooctadecanoic acid, 2-bromoeicosanoic acid, 2-bromodocosanoic acid, 2-bromotetracosanoic acid, 3-bromooctadecanoic acid, 3-bromoeicosanoic acid, 2,3-dibromooctadecanoic acid, 2-fluorododecanoic acid, 2-fluorotetradecanoic acid, 2-fluorohexadecanoic acid, 2-fluorooctadecanoic acid, 2-fluoroeicosanoic acid, 2-fluorodocosanoic acid, 2-iodohexadecanoic acid, 2-iodooctadecanoic acid, 3-iodohexadecanoic acid, 3-iodooctadecanoic acid, and perfluorooctadecanoic acid.

(B-3) Compounds having an aliphatic group having 12 or more carbon atoms, including an oxo group with at least one carbon atom at the α-position, β-position or γ-position of the aliphatic carboxylic acid compound constituting an oxo group can be preferably employed.

Specific examples of such compounds are as follows: 2-oxododecanoic acid, 2-oxotetradecanoic acid, 2-oxohexadecanoic acid, 2-oxooctadecanoic acid, 2-oxoeicosanoic acid, 2-oxotetracosanoic acid, 3-oxododecanoic acid, 3-oxotetradecanoic acid, 3-oxohexadecanoic acid, 3-oxooctadecanoic acid, 3-oxoeicosanoic acid, 3-oxotetracosanoic acid, 4-oxohexadecanoic acid, 4-oxooctadecanoic acid, and 4-oxodocosanoic acid.

(B-4) Dibasic acid compound represented by the following general formula (III):

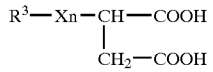

(III)

wherein $R^3$ represents an aliphatic group having 12 or more carbon atoms, X represents an oxygen or sulfur atom, and n represents 1 or 2.

Specific examples of the dibasic acid compound represented by general formula (III) are as follows: dodecylmalic acid, tetradecylmalic acid, hexadecylmalic acid, octadecylmalic acid, eicosylmalic acid, docosylmalic acid, tetracosylmalic acid, dodecylthiomalic acid, tetradecylthiomalic acid, hexadecylthiomalic acid, octadecylthiomalic acid, eicosylthiomalic acid, docosylthiomalic acid, tetracosylthiomalic acid, dodecyldithiomalic acid, tetradecyldithiomalic acid, hexadecyldithiomalic acid, octadecyldithiomalic acid, eicosyldithiomalic acid, docosyldithiomalic acid, and tetracosyldithiomalic acid.

(B-5) Dibasic acid compound represented by the following general formula (IV):

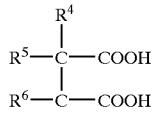

(IV)

wherein $R^4$, $R^5$ and $R^6$ each represent hydrogen, and an aliphatic group, at least one of $R^4$, $R^5$ and $R^6$ being an aliphatic group having 12 or more carbon atoms.

Specific examples of the dibasic acid compound represented by general formula (IV) are as follows: dodecylbutanedioic acid, tridecylbutanedioic acid, tetradecylbutanedioic acid, pentadecylbutanedioic acid, octadecylbutanedioic acid, eicosylbutanedioic acid, docosylbutanedioic acid, 2,3-dihexadecylbutanedioic acid, 2,3-dioctadecylbutanedioic acid, 2-methyl-3-dodecylbutanedioic acid, 2-methyl-3-tetradecylbutanedioic acid, 2-methyl-3-hexadecylbutanedioic acid, 2-ethyl-3-dodecylbutanedioic acid, 2-propyl-3-dodecylbutanedioic acid, 2-octyl-3-hexadecylbutanedioic acid, and 2-tetradecyl-3-octadecylbutanedioic acid.

(B-6) Dibasic acid compound represented by the following general formula (V):

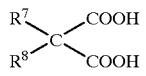

(V)

wherein $R^7$ and $R^8$ each represent hydrogen, and an aliphatic group, at least one of $R^7$ or $R^8$ being an aliphatic group having 12 or more carbon atoms.

Specific examples of the dibasic acid compound represented by general formula (V) are as follows: dodecylialonic acid, tetradecylmalonic acid, hexadecylmalonic acid, octadecylmalonic acid, eicosylmalonic acid, docosylmalonic acid, tetracosylmalonic acid, didodecylmalonic acid, ditetradecylmalonic acid, dihexadecylmalonic acid, dioctadecylmalonic acid, dieicosylmalonic acid, didocosylmalonic acid, methyloctadecylmalonic acid, methyleicosylmalonic acid, methyldocosylmalonic acid, methyltetracosylmalonic acid, ethyloctadecylmalonic acid, ethyleicosylmalonic acid, ethyldocosylmalonic acid, and ethyltetracosylmalonic acid.

(B-7) Dibasic acid compound represented by the following general formula (VI):

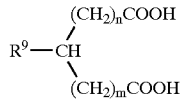

(VI)

wherein $R^9$ represents an aliphatic group having 12 or more carbon atoms; and n is an integer of 0 or 1, m is an integer of 1, 2 or 3, and when n is 0, m is 2 or 3, while when n is 1, m is 1 or 2.

Specific examples of the dibasic acid compound represented by general formula (VI) are as follows: 2-dodecyl-pentanedioic acid, 2-hexadecyl-pentanedioic acid, 2-octadecyl-pentanedioic acid, 2-eicosyl-pentanedioic acid, 2-docosyl-pentanedioic acid, 2-dodecyl-hexanedioic acid, 2-pentadecyl-hexanedioic acid, 2-octadecyl-hexanedioic acid, 2-eicosyl-hexanedioic acid, and 2-docosyl-hexanedioic acid.

(B-8) Tribasic acid compounds such as citric acid acylated by a long chain aliphatic acid:

Specific examples of such compounds are as follows:

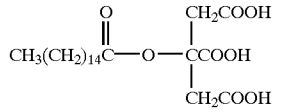

,

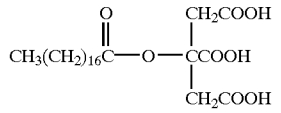

, and

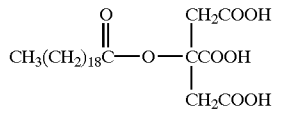

.

(C) Phenolic compounds such as a compound represented by the following general formula (VII):

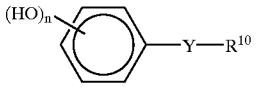

(VII)

wherein Y represents —S—, —O—, —CONH—, or —COO—; $R^{10}$ represents an aliphatic group having 12 or more carbon atoms; and n is an integer of 1 to 3.

Specific examples of the phenolic compound represented by general formula (VII) are as follows: p-(dodecylthio)phenol, p-(tetradecylthio)phenol, p-(hexadecylthio)phenol, p-(octadecylthio)phenol, p-(eicosylthio)phenol, p-(docosylthio)phenol, p-(tetracosylthio)phenol, p-(dodecyloxy)phenol, p-(tetradecyloxy)phenol, p-(hexadecyloxy)phenol, p-(octadecyloxy)phenol, p-(eicosyloxy)phenol, p-(docosyloxy)phenol, p-(tetracosyloxy)phenol, p-dodecylcarbamoylphenol, p-tetradecylcarbamoylphenol, p-hexadecylcarbamoylphenol, p-octadecylcarbamoylphenol, p-eicosylcarbamoylphenol, p-docosylcarbamoylphenol, p-tetracosylcarbamoylphenol, hexadecyl gallate, octadecyl gallate, eicosyl gallate, docosyl gallate, and tetracosyl gallate.

(D) Other organic phosphoric acid compounds such as α-hydroxyalkyl phosphonic acid represented by the following general formula (VIII):

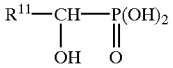

(VIII)

wherein $R^{11}$ represents an aliphatic group having 11 to 29 carbon atoms.

Specific examples of the α-hydroxyalkyl phosphonic acid represented by general formula (VIII) are as follows: α-hydroxydodecyl phosphonic acid, α-hydroxytetradecyl phosphonic acid, α-hydroxyhexadecyl phosphonic acid, α-hydroxyoctadecyl phosphonic acid, α-hydroxyeicosyl phosphonic acid, α-hydroxydocosyl phosphonic acid, and α-hydroxytetracosyl phosphonic acid.

(E) Metallic salts of mercaptoacetic acids such as an alkyl mercaptoacetic acid or alkenyl mercaptoacetic acid represented by the following general formula (IX):

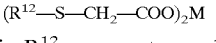

(IX)

wherein $R^{12}$ represents an aliphatic group having 10 to 18 carbon atoms; and M represents tin, magnesium, zinc, or copper.

Specific examples of the metallic salt of the mercaptoacetic acid represented by general formula (IX) are as follows: tin decylmercaptoacetate, tin dodecylmercaptoacetate, tin tetradecylmercaptoacetate, tin hexadecylmercaptoacetate, tin octadecylmercaptoacetate, magnesium decylmercaptoacetate, magnesium dodecylmercaptoacetate, magnesium tetradecylmercaptoacetate, magnesium hexadecylmercaptoacetate, magnesium octadecylmercaptoacetate, zinc decylmercaptoacetate, zinc dodecylmercaptoacetate, zinc tetradecylmercaptoacetate, zinc hexadecylmercaptoacetate, zinc octadecylmercaptoacetate, copper decylmercaptoacetate, copper dodecylmercaptoacetate, copper tetradecylmercaptoacetate, copper hexadecylmercaptoacetate, and copper octadecylmercaptoacetate.

The coloring agents for the thermal coloring functional element for use in the present invention, electron-donor compounds which are colorless or light-colored before color formation is induced therein.

Examples of such compounds are conventionally known triphenylmethane phthalide compounds, fluoran compounds, phenothiazine compounds, leuco auramine compounds and indolinophthalide compounds.

Compounds represented by the following general formulas (X) and (XI) can be employed as preferable coloring agents for use in the present invention.

(X)

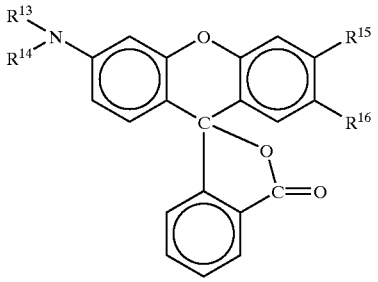

(XI)

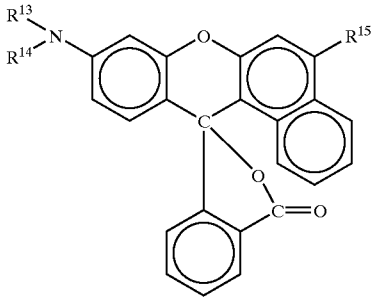

wherein $R^{13}$ represents hydrogen or an alkyl group having 1 to 4 carbon atoms; $R^{14}$ represents an alkyl group having 1 to 6 carbon atoms, a cyclohexyl group, or a phenyl group which may have a substituent; $R^{15}$ represents hydrogen, an alkyl group or alkoxyl group having 1 to 2 carbon atoms, or halogen; and $R^{16}$ represents hydrogen, a methyl group, halogen, or an amino group which may have a substituent.

Examples of the substituent for the phenyl group are alkyl groups such as methyl group and ethyl group; alkoxyl groups such as methoxy group and ethoxy group; and halogen.

Examples of the substituent for the amino group are alkyl group, aryl group which may have a substituent, and aralkyl group which may have a substituent. The substituents for the aryl group or the aralkyl group can be selected from a group consisting of alkyl group, halogen and alkoxyl group.

Specific examples of the compound used as the coloring agent represented by general formula (X) or (XI) are as follows:

2-anilino-3-methyl-6-diethylaminofluoran,
2-anilino-3-methyl-6-(di-n-butylamino)fluoran,
2-anilino-3-methyl-6-(N-n-propyl-N-methylamino)fluoran,
2-anilino-3-methyl-6-(N-isopropyl-N-methylamino)fluoran,
2-anilino-3-methyl-6-(N-isobutyl-N-methylamino)fluoran,
2-anilino-3-methyl-6-(N-n-amyl-N-methylamino)fluoran,
2-anilino-3-methyl-6-(N-sec-butyl-N-ethylamino)fluoran,
2-anilino-3-methyl-6-(N-n-amyl-N-ethylamino)fluoran,
2-anilino-3-methyl-6-(N-iso-amyl-N-ethylamino)fluoran,
2-anilino-3-methyl-6-(N-n-propyl-N-isopropylamino) fluoran,
2-anilino-3-methyl-6-(N-cyclohexyl-N-methylamino) fluoran,
2-anilino-3-methyl-6-(N-ethyl-p-toluidino)fluoran,
2-anilino-3-methyl-6-(N-methyl-p-toluidino)fluoran,
2-(m-trichloromethylanilino)-3-methyl-6-diethylaminofluoran,
2-(m-trifluoromethylanilino)-3-methyl-6-diethylaminofluoran,
2-(m-trifluoromethylanilino)-3-methyl-6-(N-cyclohexyl-N-methylamino)fluoran,
2-(2,4-dimethylanilino)-3-methyl-6-diethylaminofluoran,
2-(N-ethyl-p-toluidino)-3-methyl-6-(N-ethylanilino) fluoran,
2-(N-methyl-p-toluidino)-3-methyl-6-(N-propyl-p-toluidino)fluoran
2-anilino-6-(N-n-hexyl-N-ethylamino)fluoran,
2-(o-chloroanilino)-6-diethylaminofluoran,
2-(o-bromoanilino)-6-diethylaminofluoran,
2-(o-chloroanilino)-6-dibutylaminofluoran,
2-(o-fluoroanilino)-6-dibutylaminofluoran,
2-(m-trifluoromethylanilino)-6-diethylaminofluoran,
2-(p-acetylanilino)-6-(N-n-amyl-N-n-butylamino)fluoran,
2-benzylamino-6-(N-ethyl-p-toluidino)fluoran,
2-benzylamino-6-(N-methyl-2,4-dimethylanilino)fluoran,
2-benzylamino-6-(N-ethyl-2,4-dimethylanilino)fluoran,
2-dibenzylamino-6-(N-methyl-p-toluidino)fluoran,
2-dibenzylamino-6-(N-ethyl-p-toluidino)fluoran,
2-(di-p-methylbenzylamino)-6-(N-ethyl-p-toluidino) fluoran,
2-(α-phenylethylamino)-6-(N-ethyl-p-toluidino)fluoran,
2-methylamino-6-(N-methylanilino)fluoran,
2-methylamino-6-(N-ethylanilino)fluoran,
2-methylamino-6-(N-propylanilino)fluoran,
2-ethylamino-6-(N-methyl-p-toluidino)fluoran,
2-methylamino-6-(N-methyl-2,4-dimethylanilino)fluoran,
2-ethylamino-6-(N-ethyl-2,4-dimethylanilino)fluoran,
2-dimethylamino-6-(N-methylanilino)fluoran,
2-dimethylamino-6-(N-ethylanilino)fluoran,
2-diethylamino-6-(N-methyl-p-toluidino)fluoran,
2-diethylamino-6-(N-ethyl-p-toluidino)fluoran,
2-dipropylamino-6-(N-methylanilino)fluoran,
2-dipropylamino-6-(N-ethylanilino)fluoran,
2-amino-6-(N-methylanilino)fluoran,
2-amino-6-(N-ethylanilino)fluoran,
2-amino-6-(N-propylanilino)fluoran,
2-amino-6-(N-methyl-p-toluidino)fluoran,
2-amino-6-(N-ethyl-p-toluidino)fluoran,
2-amino-6-(N-propyl-p-toluidino)fluoran,
2-amino-6-(N-methyl-p-ethylanilino)fluoran,
2-amino-6-(N-ethyl-p-ethylanilino)fluoran,
2-amino-6-(N-propyl-p-ethylanilino)fluoran,
2-amino-6-(N-methyl-2,4-dimethylanilino)fluoran,
2-amino-6-(N-ethyl-2,4-dimethylanilino)fluoran,
2-amino-6-(N-propyl-2,4-dimethylanilino)fluoran,
2-amino-6-(N-methyl-p-chloroanilino)fluoran,
2-amino-6-(N-ethyl-p-chloroanilino)fluoran,
2-amino-6-(N-propyl-p-chloroanilino)fluoran,
2,3-dimethyl-6-dimethylaminofluoran,
3-methyl-6-(N-ethyl-p-toluidino)fluoran,
2-chloro-6-diethylaminofluoran,
2-bromo-6-diethylaminofluoran,
2-chloro-6-dipropylaminofluoran,
3-chloro-6-cyclohexylaminofluoran,
3-bromo-6-cyclohexylaminofluoran,
2-chloro-6-(N-ethyl-N-isoamylamino)fluoran,
2-chloro-3-methyl-6-diethylaminofluoran,
2-anilino-3-chloro-6-diethylaminofluoran,
2-(o-chloroanilino)-3-chloro-6-cyclohexylaminofluoran,
2-(m-trifluoromethylanilino)-3-chloro-6-diethylaminofluoran,
2-(2,3-dichloroanilino)-3-chloro-6-diethylaminofluoran,
1,2-benzo-6-diethylaminofluoran,
1,2-benzo-6-(N-ethyl-N-isoamylamino)fluoran, 1,2-benzo-6-dibutylaminofluoran,
1,2-benzo-6-(N-methyl-N-cyclohexylamino)fluoran, and
1,2-benzo-6-(N-ethyl-toluidino)fluoran.

Specific examples of compounds used as the coloring agent other than the fluoran compound represented by general formula (X) or (XI) are as follows:

2-anilino-3-methyl-6-(N-2-ethoxypropyl-N-ethylamino) fluoran,
2-(p-chloroanilino)-6-(N-n-octylamino)fluoran,
2-(p-chloroanilino)-6-(N-n-palmitylamino)fluoran,
2-(p-chloroanilino)-6-(di-n-octylamino)fluoran,
2-benzoylamino-6-(N-ethyl-p-toluidino)fluoran,
2-(o-methoxybenzoylamino)-6-(N-methyl-p-toluidino) fluoran,
2-dibenzylamino-4-methyl-6-diethylaminofluoran,
2-dibenzylamino-4-methoxy-6-(N-methyl-p-toluidino) fluoran,
2-benzylamino-4-methyl-6-(N-ethyl-p-toluidino)fluoran,
2-(α-phenylethylamino)-4-methyl-6-diethylaminofluoran,
2-(p-toluidino)-3-(t-butyl)-6-(N-methyl-p-toluidino)fluoran,
2-(o-methoxycarbonylanilino)-6-diethylaminofluoran,
2-acetylamino-6-(N-methyl-p-toluidino)fluoran,
3-diethylamino-6-(m-trifluoromethylanilino)fluoran,
4-methoxy-6-(N-ethyl-p-toluidino)fluoran,
2-ethoxyethylamino-3-chloro-6-dibutylaminofluoran,
2-dibenzylamino-4-chloro-6-(N-ethyl-p-toluidino)fluoran,
2-(α-phenylethylamino)-4-chloro-6-diethylaminofluoran,
2-(N-benzyl-p-trifluoromethylanilino)-4-chloro-6-diethylaminofluoran.
2-anilino-3-methyl-6-pyrrolidinofluoran,
2-anilino-3-chloro-6-pyrrolidinofluoran,
2-anilino-3-methyl-6-(N-ethyl-N-tetrahydrofurfurylamino) fluoran,
2-mesidino-4',5'-benzo-6-diethylaminofluoran,
2-(m-trifluoromethylanilino)-3-methyl-6-pyrrolidinofluoran,
2-(α-naphthylamino)-3,4-benzo-4'-bromo-6-(N-benzyl-N-cyclohexylamino)fluoran,
2-piperidino-6-diethylaminofluoran,
2-(N-n-propyl-p-trifluoromethylanilino)-6-morpholinofluoran,
2-(di-N-p-chlorophenylmethylamino)-6-pyrrolidinofluoran,
2-(N-n-propyl-m-trifluoromethylanilino)-6-morpholinofluoran,
1,2-benzo-6-(N-ethyl-N-n-octylamino)fluoran,
1,2-benzo-6-diallylaminofluoran,
1,2-benzo-6-(N-ethoxyethyl-N-ethylamino)fluoran, benzoleuco methylene blue,
2-[3,6-bis(diethylamino)]-6-(o-chloroanilino)xanthyl benzoic acid lactam,
2-[3,6-bis(diethylamino)]-9-(o-chloroanilino)xanthyl benzoic acid lactam,
3,3-bis(p-dimethylaminophenyl)-phthalide,
3,3-bis(p-dimethylaminophenyl)-6-dimethylaminophthalide (or Crystal Violet Lactone)
3,3-bis(p-dimethylaminophenyl)-6-diethylaminophthalide,
3,3-bis(p-dimethylaminophenyl)-6-chlorophthalide,
3,3-bis(p-dibutylaminophenyl)phthalide,
3-(2-methoxy-4-dimethylaminophenyl)-3-(2-hydroxy-4,5-dichlorophenyl)phthalide,
3-(2-hydroxy-4-dimethylaminophenyl)-3-(2-methoxy-5-chlorophenyl)phthalide,
3-(2-hydroxy-4-dimethyoxyaminophenyl)-3-(2-methoxy-5-chlorophenyl)phthalide,
3-(2-hydroxy-4-dimethylaminophenyl)-3-(2-methoxy-5-nitrophenyl)phthalide,
3-(2-hydroxy-4-diethylaminophenyl)-3-(2-methoxy-5-methylphenyl)phthalide,
3-(2-methoxy-4-dimethylaminophenyl)-3-(2-hydroxy-4-chloro-5-methoxyphenyl)phthalide,
3,6-bis(dimethylamino)fluorenespiro(9,3')-6'-dimethylaminophthalide,
6'-chloro-8'-methoxy-benzoindolino-spiropyran, and
6'-bromo-2'-methoxy-benzoindolino-spiropyran.

It is necessary to use the coloring agent and the color developer in an appropriate ratio in accordance with the properties of the compounds employed. It is preferable that the color developer be employed in an amount of 1 to 20 moles, more preferably in an amount of 2 to 10 moles, to 1 mole of the coloring agent, in order to obtain an appropriate color density for use in practice.

Depending upon the amount ratio of the color developer to the coloring agent, the decolorization characteristics of the functional element are changed. Namely, as the amount of the color developer is relatively increased, the decolorization initiation temperature tends to be lowered, while as the amount of the color developer is relatively decreased, the decolorization becomes sensitive to the changes in the temperature. Therefore, the ratio of the coloring agent to the color developer should be appropriately selected, with the application purpose thereof taken into consideration.

Additives for controlling the crystallization of the color developer can be added to the reversible thermosensitive coloring functional element for improving the properties thereof such as decolorizing properties and preservability.

A reversible thermosensitive recording medium using any of the above-mentioned reversible thermal coloring functional element will be now explained. The term "reversible thermosensitive recording medium" also includes a display medium.

The above-mentioned reversible thermosensitive coloring functional element comprises a support and a recording layer formed thereon, which comprises the above-mentioned reversible thermal coloring functional element.

Any materials which can support the recording layer thereon can be employed as the materials for the above-mentioned support. For example, paper, synthetic paper, a plastic film, a composite film of the paper and the plastic film, and a glass plate can be employed as the support.

The recording layer can be formed in any shape as long as the functional element can be contained therein.

If necessary, a binder resin may be contained in the recording layer to retain the shape of the recording layer.

As the binder resin, for example, polyvinyl chloride, polyvinyl acetate, vinyl chloride-vinyl acetate copolymer, polystyrene, styrene copolymer, phenoxy resin, polyester, aromatic polyester, polyurethane, polycarbonate, polyacrylic acid ester, polymethacrylic acid ester, acrylic acid copolymer, maleic acid copolymer, and polyvinyl alcohol can be employed.

Moreover, the functional elements can be microcapsuled before use. The functional elements can be microcapsuled by a conventional method such as the coacervation method, the interfacial polymerization method, or the in-situ polymerization method.

The recording layer can be formed by a conventional method. More specifically, a coloring agent and a color developer are uniformly dispersed or dissolved in water or in an organic solvent, together with a binder resin to prepare a coating liquid. The thus prepared coating liquid is coated on the support and dried, whereby a recording layer is formed.

The binder resin employed in the recording layer serves to maintain the functional element in a uniformly dispersed state in the recording layer even when color development and decolorization are repeated. It is preferable that the binder resin have high heat resistance in order to prevent the coagulation of the functional element while in use with the repetition of color development and decolorization.

When no binder resin is employed, the functional element is fused to form a film layer and cooled so as to use the element as a recording layer.

The light-resistance of the reversible thermosensitive coloring recording medium for use in the present invention can be improved by containing a light stabilizer in the recording layer. As such light stabilizers for use in the present invention, an ultraviolet absorber, an antioxidant, an anti-aging agent, a singlet-oxygen quenching agent, a superoxide-anion quenching agent can be employed.

When reversible thermosensitive recording is conducted by using the reversible thermosensitive recording medium, the recording medium is caused to assume a color development state by temporarily heating the recording medium to a temperature which is above the melting point of the mixture of the coloring agent and the color developer in the recording layer. When recorded information is erased, the recording medium which is in the color development state is heated to a decolorization initiation temperature which is below the above-mentioned melting point of the mixture of the coloring agent and the color developer.

To record an image on the recording medium, an image which is in the color development state may be formed on the background which is in the decolorization state, or an image in the decolorization state may be recorded on the background in the color development state. In any case, when heat is imagewise applied to the recording medium, heating means capable of partially applying heat to the recording medium, such as a hot-pen, a thermal head, or a laser beam, is used.

In the case where color development or decolorization is carried out on the entire surface of the recording medium, the recording medium may be brought into contact with a heat roller or a heat plate, or exposed to hot air, or placed in a heated temperature-controlled chamber, or irradiated by an infrared ray. Alternatively, heat can be applied to the entire surface of the receding medium by a thermal head.

The method of reversible selective manifestation of different states of a functional element according to the present invention has been explained by use of examples of the functional elements comprising a coloring agent and a color developer. The present invention is not limited to those examples, but can be applied to other functional elements, which can reversibly assume a first state in which two compounds interact, and a second state in which the two compounds do not interact.

For example, the method of the present invention can be applied to a functional element comprising a phosphonic acid with a long alkyl chain and a gallate with a long alkyl chain in combination.

More specifically, a mixture of docosylphosphonic acid and octadecyl gallate in a molar ratio of 5:1 was fused.

A functional element [A] was prepared by rapidly cooling the fused mixture. A functional element [B] was prepared by gradually cooling the fused mixture.

Figure 9:
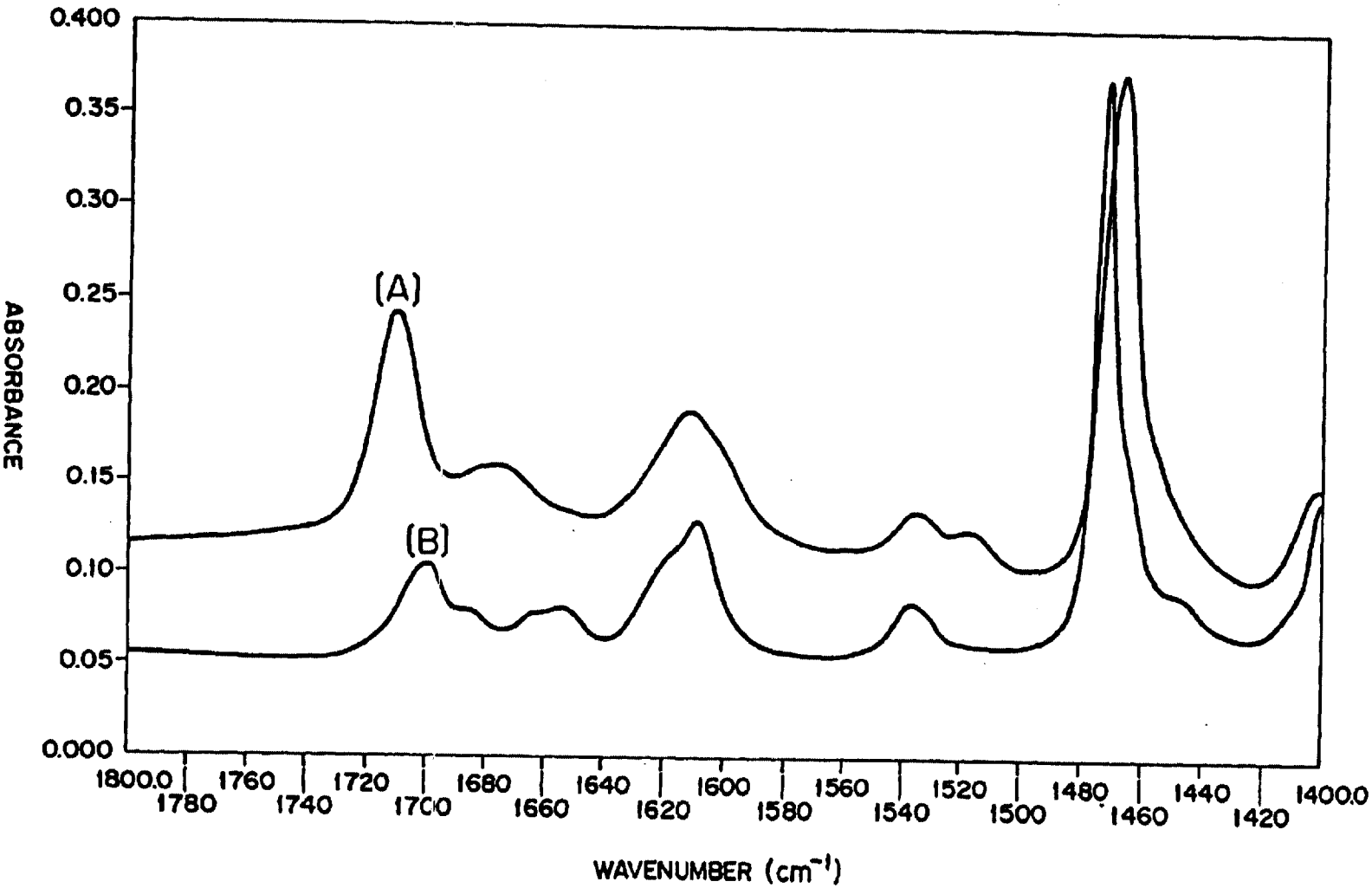
FIG. 9 is an infrared absorption spectrum chart showing the changes in the interaction state of two compounds in two functional elements, when one functional element was cooled promptly, and the other was cooled gradually.

FIG. 9 shows an infrared spectrum of the functional element [A] and an infrared spectrum of the functional element [B]. In FIG. 9, the peak near 1700 $cm^{-1}$ in the curve for the functional element [A] and that in the curve for the functional element [B] respectively indicate a characteristic absorption peak of C═O stretching vibration of the octadecyl gallate in the two functional elements. The two peaks are greatly different. This indicates that the interaction state between the octadecyl gallate and the docosylphosphonic acid in the functional element [A] is significantly different from the interaction state between the two compounds in the functional element [B].

Figure 10:
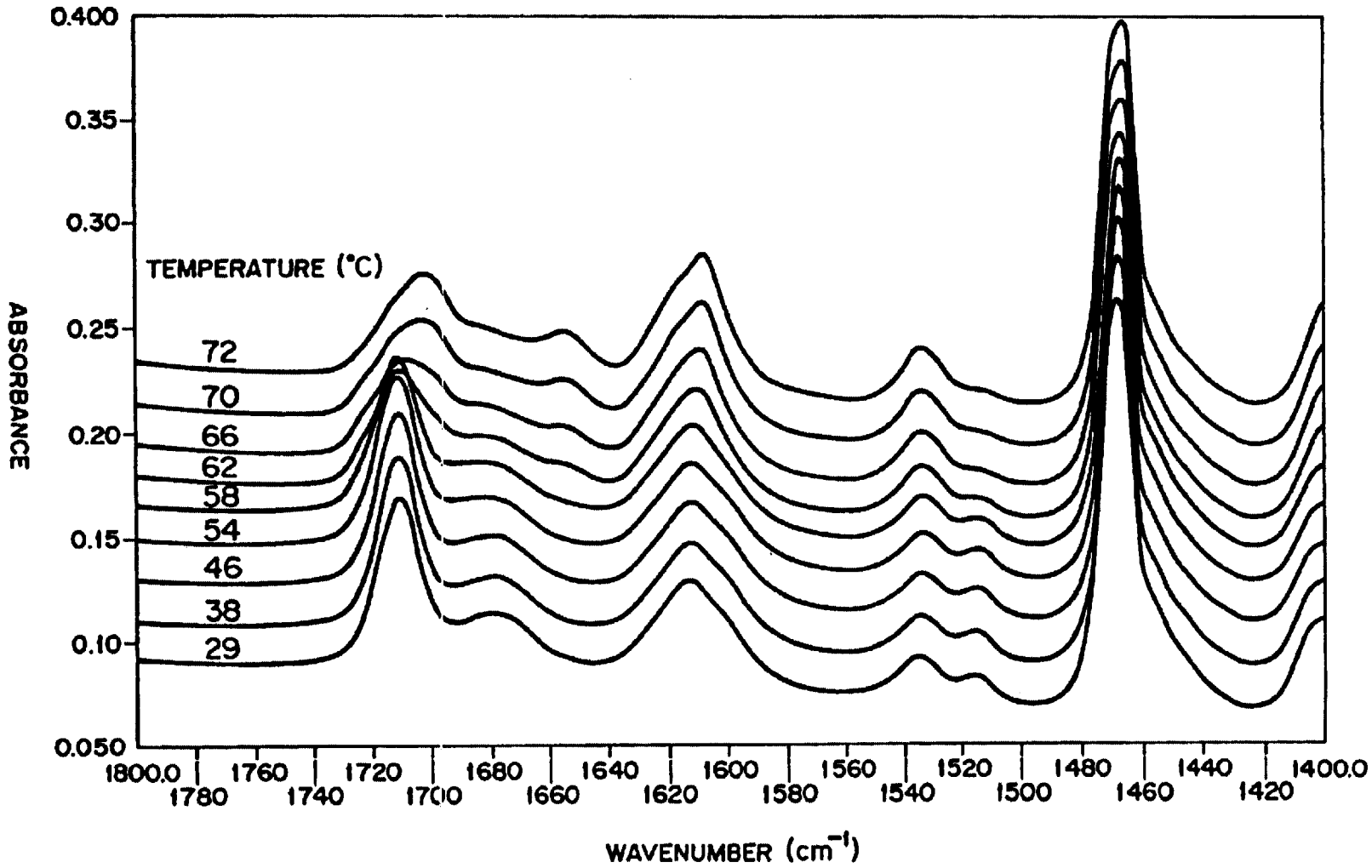
FIG. 10 is an infrared absorption spectrum chart showing the changes in the interaction state of two compounds in a functional element depending upon temperature thereof when the temperature of a rapidly cooled functional element was elevated.

FIG. 10 shows an infrared spectrum of the functional element [A] measured as the temperature thereof was increased. FIG. 10 shows that the infrared spectrum changes around at 60° C. which is far below a temperature at which the two compounds are fused, that is, 93° C., and that the functional element [A] eventually reaches the same state as that of the functional element [B]. More specifically, when the functional element [A] was further heated to 70 to 90° C., the infrared spectrum of the functional element [A] became the same as that of the functional element [B].

Figure 11:
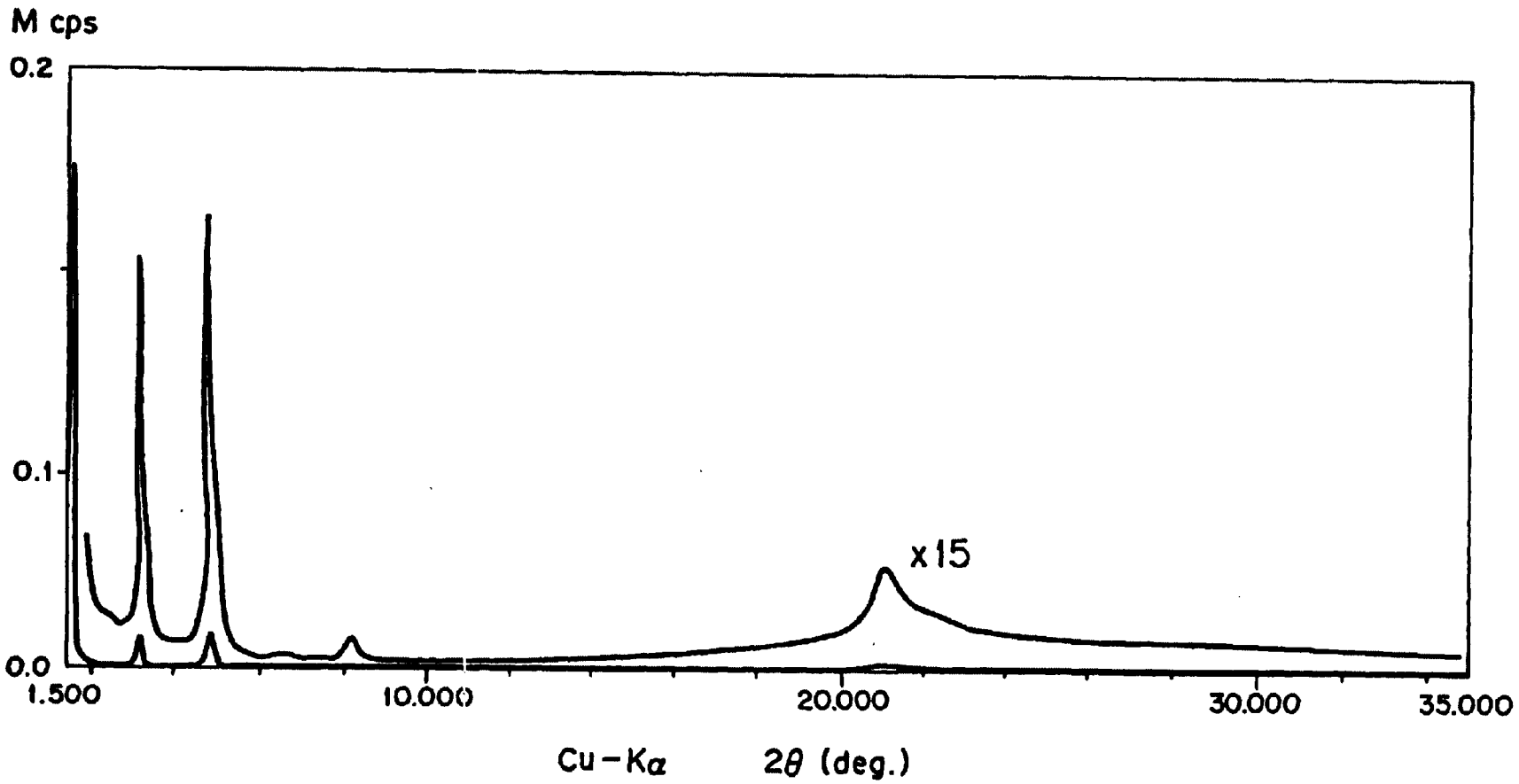
FIG. 11 is an x-ray diffraction chart showing the formation of a regular aggregate structure in a functional element formed by rapidly cooling.
Figure 12:
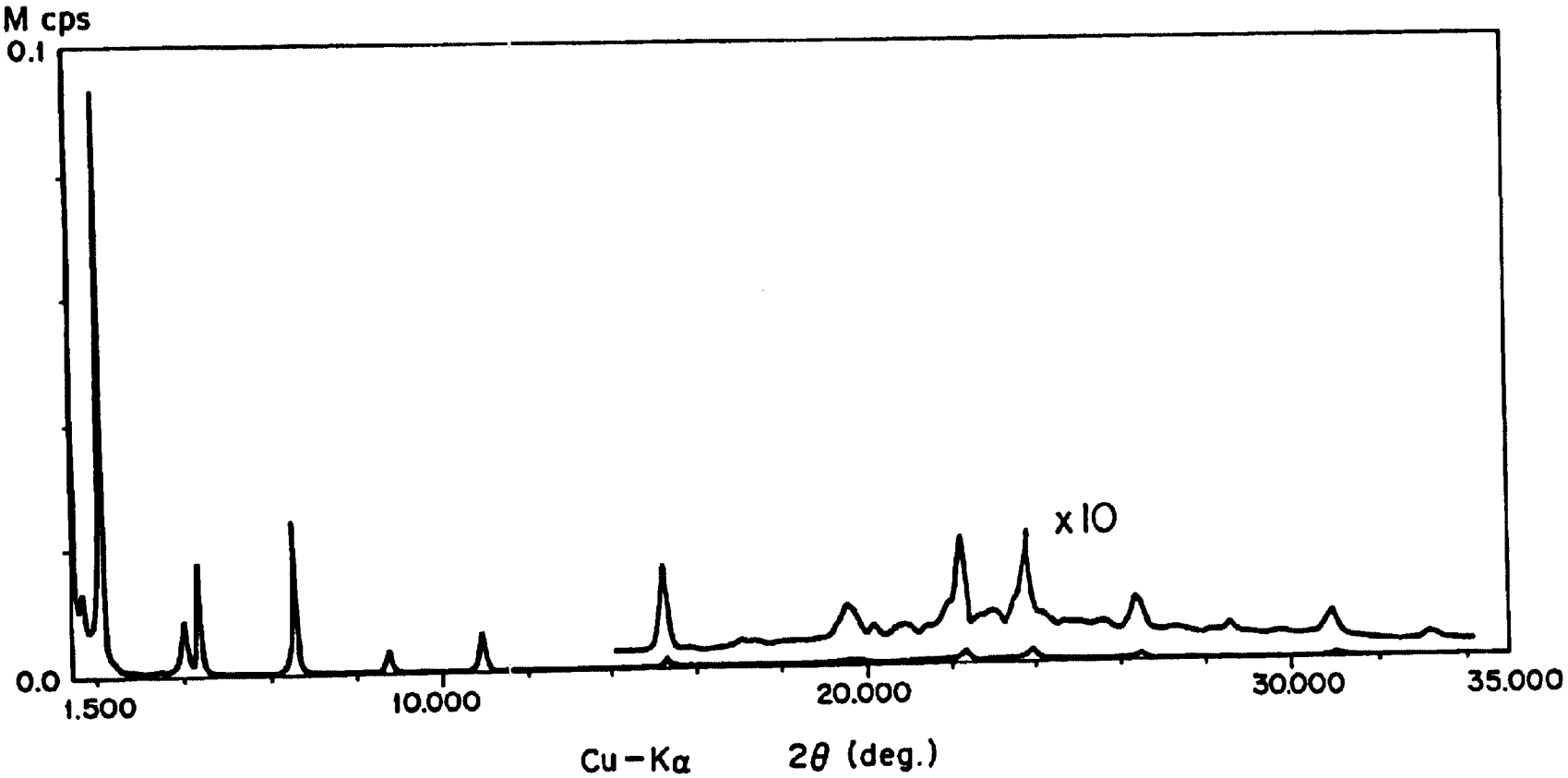
FIG. 12 is an x-ray diffraction chart showing the formation of independent crystals of two compounds in a functional element formed by gradual cooling.

FIGS. 11 and 12 are x-ray diffraction charts of the functional elements [A] and [B], respectively.

In the functional element [A], diffraction peaks are observed at 1.59°, 3.22°, 4.84° and 21.1° indicating the formation of a regular aggregate structure of the two compounds. These peaks do not correspond to the diffraction peaks of the crystals of docosylphosphonic acid and octadecyl gallate, but indicate that a regular aggregate structure of docosylphosphonic acid and octadecyl gallate is formed by the interaction between the two compounds.

On the other hand, in the functional element [B], diffraction peaks are observed at 1.76°, 2.16°, 4.00°, 4.34°, 6.54°, 8.74°, 10.94°, 22.34° and 23.94°, and all of these peaks correspond to diffraction peaks indicating the crystallization of docosylphosphonic acid.

Therefore, it is confirmed that the docosylphosphonic acid is in an independently crystallized state in the functional element [B].

Figure 13A:
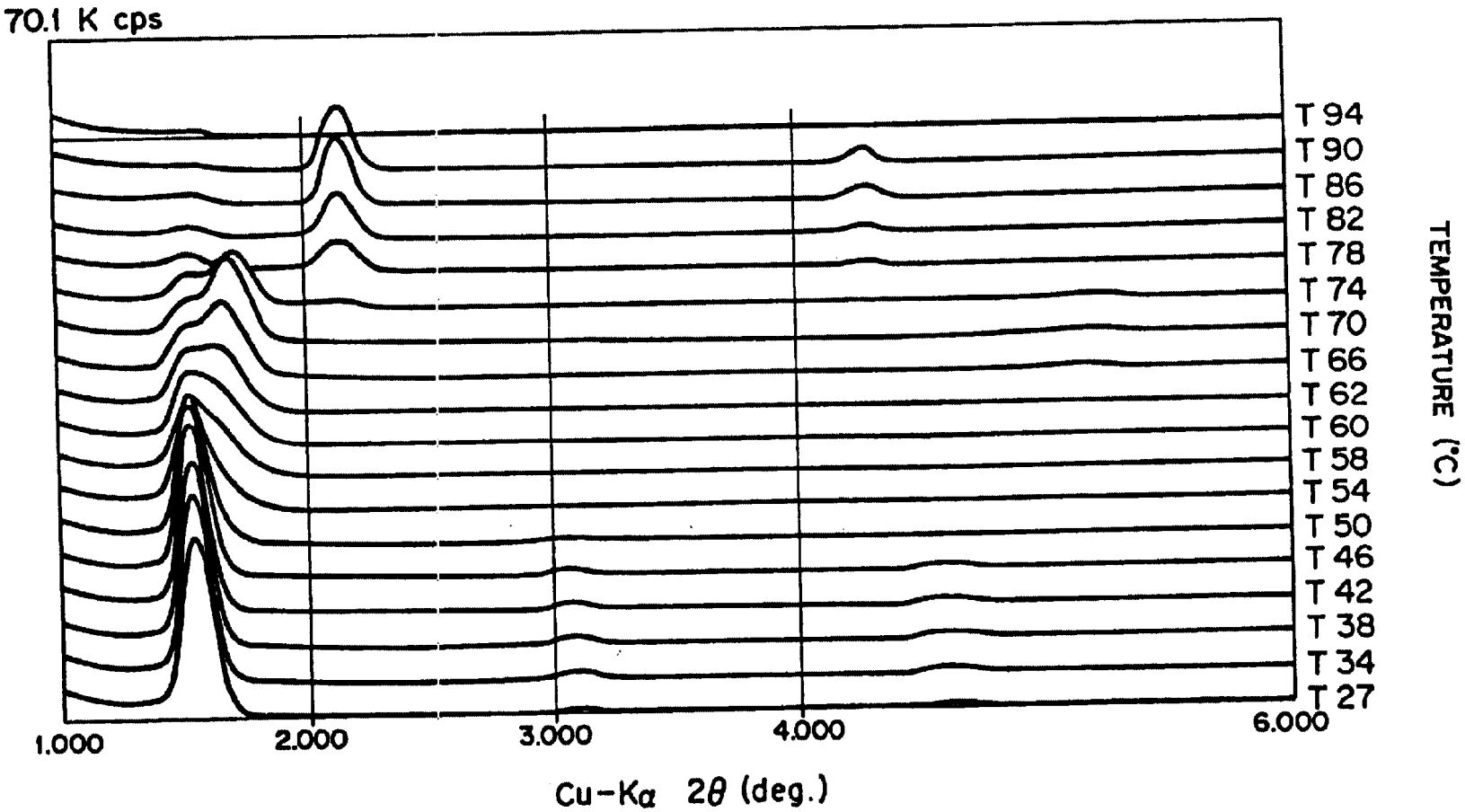
FIGS. 13(*a*) and 13(*b*) are x-ray diffraction charts showing changes in the x-ray diffraction in the functional element comprising two compounds formed by rapid cooling, indicating that one of the two compounds is being crystallized.
Figure 13B:
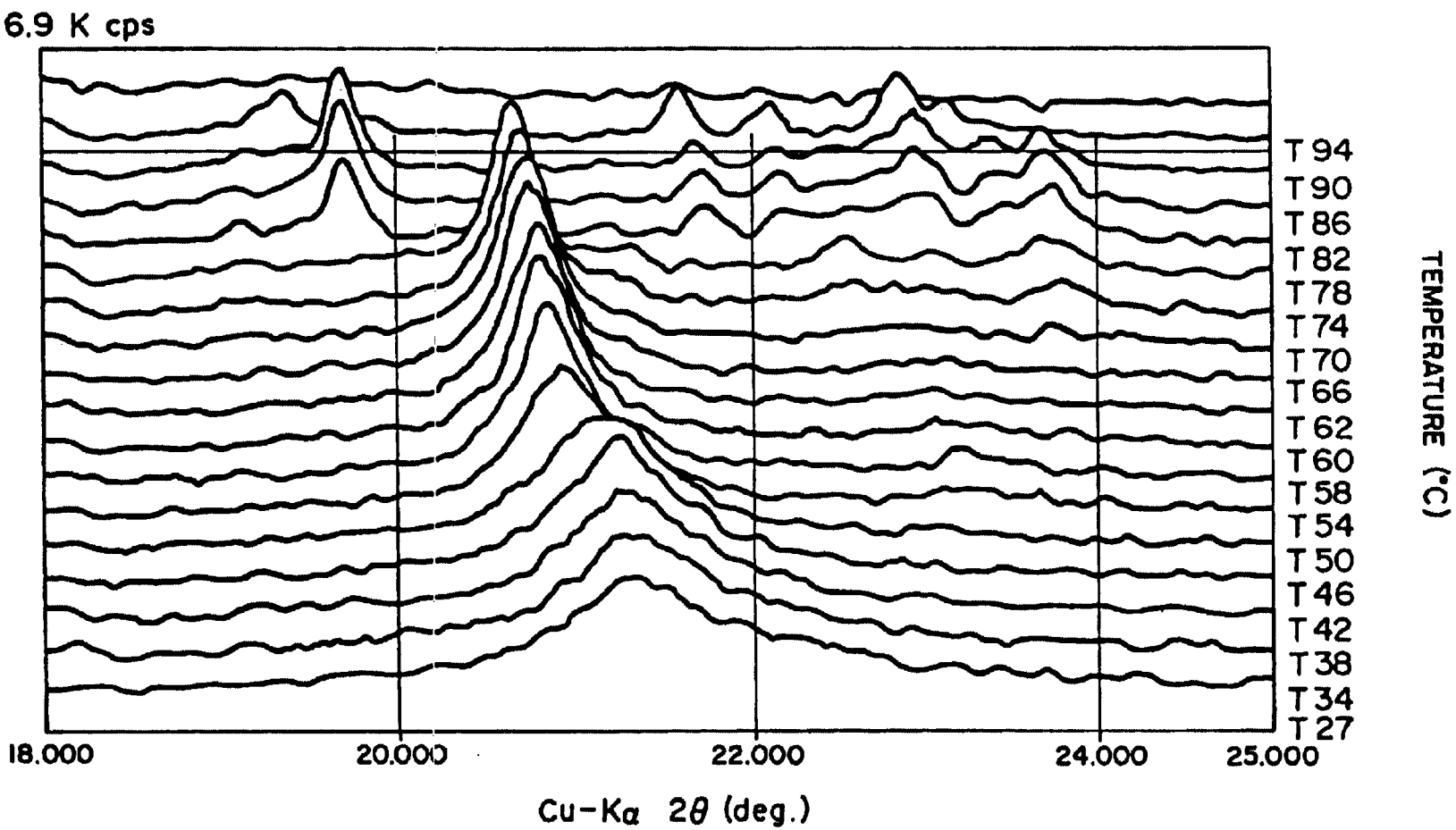

Moreover, FIGS. 13(*a*) and 13(*b*) respectively show an x-ray diffraction chart on a lower diffraction angle side and that on a higher diffraction angle side, of the functional element [A], measured as the temperature thereof was increased. FIGS. 13(*a*) and 13(*b*) both indicate that the aggregate structure of docosylphosphonic acid and octadecyl gallate formed by the interaction between the two compounds is changed to such a state in which the docosylphosphonic acid is independently crystallized at about 50-60° C.

As can be seen from the above, even in the functional element comprising docosylphosphonic acid and octadecyl gallate, it is possible to cause the functional element to reversibly assume a first state in which the two compounds interact and a second state in which the two compounds do not interact as desired by forming a regular aggregate structure of the two compounds by rapidly cooling a fused mixture of the two compounds, and destroying the regular aggregate structure to elevate the temperature thereof by the application of heat thereto, to crystallize one of the two compounds.

The above-mentioned changes between the two states can be functioned as non-linear optical reversible changes, so that the method of the present application can be effectively applied to a functional element with such non-linear optical reversible changes.

Other feature of this invention will become apparent in the course of the following description of exemplary embodiments which are given for illustration of the invention and are not intended to be limiting thereof.

EXAMPLES 1-1 TO 1-6

2-(o-chloroanilino)-6-dibutylaminofluoran serving as a coloring agent, and each of phosphonic acids with a long-chain alkyl group, serving as color developers, shown in TABLE 2 were mixed in a molar ratio of 1:5 and pulverized in a mortar.

A glass plate with a thickness of 1.2 mm was placed on a hot plate and heated to 170° C.

A small amount of each of the above mixtures was placed on the thus heated glass plate. Each mixture was melted and turned black.

Subsequently, a cover glass was placed on each of the above melted mixtures. Each melted mixture was spread so as to have a uniform thickness. The melted mixture on the glass place, with the cover glass placed thereon, was then immediately immersed in ice water to quickly lower the temperature of the melted mixture.

The melted mixture was then taken out from the ice water quickly, and water was wiped off from the melted mixture, whereby functional elements Nos. 1-1 to 1-6 were fabricated, each in the form of a colored thin film.

TABLE 2

| Example No. | Color Developer | Decolorization Initiation Temperature (° C.) | Decolorization Ratio (%) |
|---|---|---|---|
| 1-1 | Dodecylphosphonic acid | 34 | 38 |
| 1-2 | Tetradecylphosphonic acid | 46 | 60 |
| 1-3 | Hexadecylphosphonic acid | 55 | 72 |
| 1-4 | Octadecylphosphonic acid | 63 | 81 |
| 1-5 | Eicosylphosphonic acid | 69 | 84 |
| 1-6 | Docosylphosphonic acid | 74 | 86 |

The thus fabricated functional elements Nos. 1-1 to 1-6 were subjected to an evaluation test for evaluating the color development properties and the decolorizing properties thereof as follows:

A heating apparatus was provided on a specimen carrier of an optical microscope. Each sample of the above obtained functional elements in the color development state was inspected at room temperature, and also as the temperature thereof was elevated at a heating rate of 4° C./min by the heating apparatus. At the same time, the changes in the amount of light transmitted from the light source of the optical microscope through each sample to the ocular portion of the optical microscope was measured.

When the functional element was decolorized, the amount of the transmitted light was increased.

The decolorization initiation temperature of each element was determined from the temperature at which the amount of the transmitted light was changed.

It was confirmed that when the coloring functional element was further heated until it was fused, the above functional element was again colored.

It was further confirmed that the reversible thermosensitive coloring functional elements comprising one of phosphonic acids with a straight chain alkyl group having 12 to 22 carbon atoms have such transmittances as shown in FIG. 4. In FIG. 4, each of the number suffixed to P12, P14, P16, P18, P20 and P22 stands for the number of the carbon atoms in the alkyl group, as mentioned previously.

In FIG. 4, the transmittance of each of the functional elements in the initial color development state is expressed as 1.0 in terms of an arbitrary unit for comparison.

The results shown in FIG. 4 indicate that each functional element comprising the phosphonic acid has its own decolorization temperature range, and that the longer the length of the alkyl chain of the phosphonic acid contained in the element, the higher the decolorization initiation temperature thereof.

TABLE 2 also shows the decolorization initiation temperature of each functional element, and the decolorization ratio thereof. The decolorization ratio shown in TABLE 2 was determined as follows:

$$\text{Decolorization ratio} = \frac{D^Q - D^E}{D^Q} \times 100(\%)$$

In the above relationship, $D^Q$ indicates the color development density obtained by rapidly cooling the fused functional element in the color development state, and $d^E$ indicates the maximum decolorization density. As can be seen from TABLE 2, the longer the alkyl chain of phosphonic acid, the higher the decolorization ratio of the functional element. This means that excellent reversibility is obtained in the functional element comprising a phosphonic acid with the long alkyl chain.

EXAMPLES 2-1 TO 2-6

The procedure for fabricating the reversible thermosensitive coloring functional elements in Examples 1-1 to 1-6 was repeated except that the phosphonic acids employed as the color developers in Examples 1-1 to 1-6 were replaced by eicosylthiomalic acid, and the 2-(o-chloroanilino)-6-dibutylaminofluoran employed as the coloring agent in Examples 1-1 to 1-6 was replaced by each of the fluoran compounds as shown in TABLE 3, and that the color developer and the coloring agent were mixed in a molar ratio of 2:1, whereby functional elements Nos. 2-1 to 2-6 in the color development state were fabricated.

The thus fabricated reversible thermosensitive color functional elements Nos. 2-1 to 2-6 were able to maintain the color development state when cooled rapidly, but were mostly decolorized when cooled gradually.

It was confirmed from an x-ray diffraction analysis of the above functional elements that when the fused functional elements in the color development were rapidly cooled, a regular aggregate structure of the colored composite material was formed by the interaction between the color developer and the coloring agent in each of the functional elements Nos. 2-1 to 2-6, while when cooled gradually, the color developer was separately crystallized.

Figure 14:
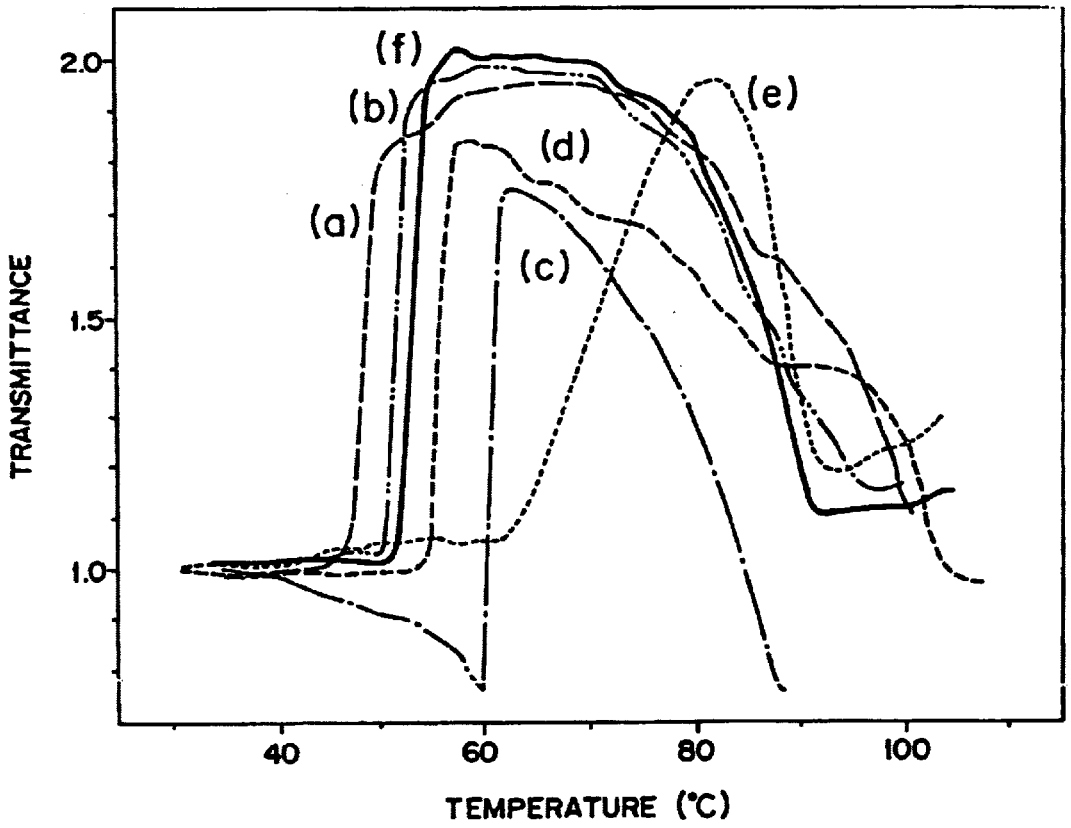
FIG. 14 is a chart showing the changes in the transmittance of functional elements in a color development state, depending upon the temperature thereof.

FIG. 14 shows the changes in the light transmittance of each of these elements in the color development state depending upon the temperature thereof. The curves (a) to (f) in FIG. 14 respectively show the changes in the light transmittance of the functional elements comprising color developers (a) to (f) shown in TABLE 3.

TABLE 3 also shows the decolorization initiation temperature of each functional element determined from the respective light transmittance and temperature thereof shown in FIG. 14.

It was confirmed that each of the functional elements Nos. 2-1 to 2-6 has a distinct decolorization temperature range and is an excellent functional element.

TABLE 3

| Example No. | Coloring Agent | Decolorization Initiation Temperature (° C.) |
|---|---|---|
| 2-1 (a) | 2-(o-chloroanilino)-6-dibutylaminofluoran | 47 |
| 2-2 (b) | 2-anilino-3-methyl-6-dibutylaminofluoran | 51 |
| 2-3 (c) | 2-anilino-3-methyl-6-diethylaminofluoran | 60 |
| 2-4 (d) | 2-anilino-3-methyl-6-(N-methyl-N-cyclohexylamino)fluoran | 55 |
| 2-5 (e) | 2-anilino-3-methyl-6-(N-methyl-N-propylamino)fluoran | 62 |
| 2-6 (f) | 2-(2,4-dimethylanilino)-3-methyl-6-diethylamino)fluoran | 51 |

EXAMPLES 3-1 TO 3-49

Each of the mixtures of the components shown in TABLE 4 was pulverized in a ball mill so as to have a particle size of 1 to 4 μm, so that recording layer coating liquids comprising a functional element comprising a color developer with a long-chain structure and a coloring agent were prepared. In TABLE 4, the term "part" is based on weight.

TABLE 4

| Ex. No. | Coloring Agent | Color Developer | Resin | Solvents |
|---|---|---|---|---|
| 3-1 | 2-(o-chloroanilino)-6-dibutylaminofluoran: 10 parts | Tetradecylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-2 | 2-(o-chloroanilino)-6-dibutylaminofluoran: 10 parts | Hexadecylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-3 | 2-(o-chloroanilino)-6-dibutylaminofluoran: 10 parts | Octadecylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-4 | 2-(o-chloroanilino)-6-dibutylaminofluoran: 10 parts | Eicosylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-5 | 2-(o-chloroanilino)-6-dibutylaminofluoran: 10 parts | Docosylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-6 | 2-anilino-3-methyl-6-(N-ethyl-p-toluidino) fluoran: 10 parts | Octadecylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-7 | 2-anilino-3-methyl-6-(N-ethyl-p-toluidino) fluoran: 10 parts | Eicosylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-8 | 1,2-benzo-6-(N-ethyl-N-isoamylamino) fluoran: 10 parts | Octadecylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-9 | 1,2-benzo-6-(N-ethyl-N-isoamylamino) fluoran: 10 parts | Eicosylphosphonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-10 | 2-(o-chloroanilino)-6-diethylaminofluoran: 10 parts | Octadecylphosphonic acid: 30 parts | Polystyrene (Made by Aldrich Japan Inc.): 20 parts (MW: 280,000) | Toluene: 200 parts Methyl ethyl ketone: 200 parts |
| 3-11 | 2-(o-chloroanilino)-6-diethylaminofluoran: 10 parts | Octadecylphosphonic acid: 30 parts | Saturated polyester (Trademark "Vylon200" made by TOYOBO CO., Ltd.): 45 parts | Toluene: 200 parts Methyl ethyl ketone: 200 parts |
| 3-12 | 2-(o-chloroanilino)-6-diethylaminofluoran: 10 parts | Eicosylphosphonic acid: 30 parts | Acrylic resin (Trademark "BR102" made by Mitsubishi Rayon Engineering Co., Ltd.): 45 parts | Toluene: 200 parts Methyl ethyl ketone: 200 parts |
| 3-13 | 2-(o-chloroanilino)-6-diethylaminofluoran: 10 parts | Eicosylphosphonic acid: 30 parts | Vinyl acetate resin (Made by Aldrich Japan Inc.): 45 parts | Toluene: 200 parts Methyl ethyl ketone: 200 parts |
| 3-14 | 3-chloro-6-cyclohexyl-aminofluoran: 10 parts | Eicosylphosphonic acid: 30 parts | Ethylcellulose (Made by Kanto Chemical Co., Inc.): 20 parts | Toluene: 200 parts Methyl ethyl ketone: 200 parts |
| 3-15 | 2-(o-chloroanilino)-6-diethylaminofluoran: 10 parts | α-hydroxyhexadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-16 | 2-(o-chloroanilino)-6-diethylaminofluoran: 10 parts | α-hydroxyoctadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |

TABLE 4-continued

| Ex. No. | Coloring Agent | Color Developer | Resin | Solvents |
|---|---|---|---|---|
| 3-17 | 2-anilino-3-methyl-6-(N-ethyl-p-toluidino) fluoran: 10 parts | α-hydroxyoctadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-18 | 2-(o-chloroanilino)-6-diethylaminofluoran: 10 parts | α-hydroxyoctadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-19 | 2-(o-chloroanilino)-6-diethylaminofluoran: 10 parts | α-hydroxyeicosanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-20 | 2-(o-chloroanilino)-6-diethylaminofluoran: 10 parts | α-hydroxyeicosanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-21 | 2-(o-chloroanilino)-6-diethylaminofluoran: 10 parts | α-hydroxytetradecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-22 | 2-(o-chloroanilino)-6-dibutylaminofluoran: 10 parts | 2-bromodocosanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-23 | 2-(o-chloroanilino)-6-dibutylaminofluoran: 10 parts | 2,3-dibromooctadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-24 | 2-(o-chloroanilino)-6-dibutylaminofluoran: 10 parts | 3-fluorooctadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-25 | 2-(o-chloroanilino)-6-dibutylaminofluoran: 10 parts | 2-fluoroeicosanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-26 | 2-(o-chloroanilino)-6-dibutylaminofluoran: 10 parts | 2-oxooctadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-27 | 2-(o-chloroanilino)-6-dibutylaminofluoran: 10 parts | 3-oxooctadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-28 | 2-(o-chloroanilino)-6-dibutylaminofluoran: 10 parts | 4-oxooctadecanoic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-29 | 2-(o-chloroanilino)-6-dibutylaminofluoran: 10 parts | Eicosylthiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-30 | 2-(o-chroloanilino)-6-diethylaminofluoran: 10 parts | Eicosylthiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-31 | 2-anilino-3-methyl-6-diethylaminofluoran: 10 parts | Eicosylthiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |

TABLE 4-continued

| Ex. No. | Coloring Agent | Color Developer | Resin | Solvents |
|---|---|---|---|---|
| 3-32 | 2-anilino-3-methyl-6-(N-methyl-N-cyclo-hexylamino)fluoran: 10 parts | Eicosylthiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-33 | 2-anilino-3-methyl-6-(N-methyl-N-propyl-amino)fluoran: 10 parts | Eicosylthiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-34 | 2(2,4-dimethylanilino)-3-methyl-5-diethyl-aminofluoran: 10 parts | Eicosylthiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-35 | 2-anilino-3-methyl-6-diethylaminofluoran: 10 parts | Octadecylthiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-36 | 2-anilino-3-methyl-6-(N-methyl-N-propyl-amino)fluoran: 10 parts | Octadecylthiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-37 | 2-anilino-3-methyl-6-(N-methyl-N-cyclo-hexylamino)fluoran: 10 parts | Octadecylthiomalic acid: 30 parts | Ethylcellulose (made by Kanto Chemical Co., Inc.): 45 parts | Toluene: 200 parts Methyl ethyl ketone: 200 parts |
| 3-38 | 2-anilino-3-methyl-6-(N-methyl-N-propyl-amino)fluoran: 10 parts | Hexadecylthiomalic acid: 30 parts | Ethylcellulose (made by Kanto Chemical Co., Inc.): 45 parts | Toluene: 200 parts Methyl ethyl ketone: 200 parts |
| 3-39 | 2-(o-chloroanilino)-6-dibutylaminofluoran: 10 parts | Octadecyldithiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-40 | 2-anilino-3-methyl-6-dibutylaminofluoran: 10 parts | Octadecyldithiomalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-41 | 2-(o-chloroanilino)-6-dibutylarainofluoran: 10 parts | Octadecylmalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-42 | 2-anilino-3-methyl-6-dibutylaminofluoran: 10 parts | Octadecylmalic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-43 | 2-(o-chloroanilino)-6-dibutylaminofluoran: 10 parts | Octadecylsuccinic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-44 | 2-anilino-3-methyl-6-dibutylaminofluoran: 10 parts | Octadecylsuccinic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-45 | 2-(o-chloroanilino)-6-dibutylaminofluoran: 10 parts | Octadecylmalonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-46 | 2-anilino-3-methyl-6-(N-methyl-p-toluidino) fluoran: 10 parts | Octadecylmalonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |

TABLE 4-continued

| Ex. No. | Coloring Agent | Color Developer | Resin | Solvents |
|---|---|---|---|---|
| 3-47 | 2-anilino-3-methyl-6-(N-methyl-p-toluidino) fluoran: 10 parts | Hexadecylmalonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-48 | 2-anilino-3-methyl-6-(N-methyl-p-toluidino) fluoran: 10 parts | Eicosylmalonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |
| 3-49 | 2-(o-chloroanilino)-6-dibutylaminofluoran: 10 parts | Eicosylmalonic acid: 30 parts | Vinyl chloride - vinyl acetate copolymer (Trademark "VYHH" made by Union Carbide Japan K.K.): 45 parts | Toluene: 200 parts Methyl ethyl ketone: 200 parts |

Each of the above prepared recording layer coating liquids was coated on a polyester film with a thickness of 100 μm, serving as a support by a wire bar, and dried, so that a recording layer with a thickness of about 6.0 was formed on the support.

Thus, reversible thermosensitive recording media Nos. 3-1 to 3-49 were obtained.

Each of the thus obtained reversible thermosensitive coloring recording media was thermally colored by a thermal-head-built-in heat gradient tester (made by Toyo Seiki Seisaku-sho, Ltd.) under the following conditions:

| | |
|---|---|
| Temperature: | 130° C. |
| Contact Time: | 1 second |
| Applied Pressure: | 1 kg/cm$^2$ |

The color density obtained in each reversible thermosensitive coloring recording medium was measured with Macbeth densitometer RD-918.

Then, each colored sample was placed in a thermostatic chamber at the decolorization initiation temperature thereof shown in TABLE 5 for about 20 seconds and decolorized.

The thus obtained color density of each of the reversible thermosensitive coloring recording media Nos. 3-1 to 3-49 and the decolorization density thereof are shown in TABLE 5.

TABLE 5

| Example No. | Color Density | Decolorization Initiation Temperature (° C.) | Decolorization Density |
|---|---|---|---|
| 3-1 | 1.63 | 60 | 0.28 |
| 3-2 | 1.68 | 67 | 0.26 |
| 3-3 | 1.72 | 73 | 0.24 |
| 3-4 | 1.73 | 82 | 0.23 |
| 3-5 | 1.70 | 84 | 0.23 |
| 3-6 | 1.84 | 73 | 0.30 |
| 3-7 | 1.88 | 82 | 0.31 |
| 3-8 | 1.61 | 73 | 0.24 |
| 3-9 | 1.65 | 82 | 0.25 |
| 3-10 | 1.53 | 73 | 0.30 |
| 3-11 | 1.55 | 73 | 0.23 |
| 3-12 | 1.78 | 82 | 0.25 |
| 3-13 | 1.82 | 82 | 0.22 |
| 3-14 | 1.86 | 82 | 0.32 |
| 3-15 | 1.47 | 70 | 0.32 |
| 3-16 | 1.44 | 70 | 0.30 |
| 3-17 | 1.50 | 70 | 0.33 |
| 3-18 | 1.44 | 70 | 0.35 |
| 3-19 | 1.48 | 70 | 0.34 |
| 3-20 | 1.41 | 70 | 0.30 |
| 3-21 | 1.48 | 65 | 0.33 |
| 3-22 | 1.42 | 50 | 0.35 |
| 3-23 | 1.35 | 50 | 0.32 |
| 3-24 | 1.31 | 55 | 0.40 |
| 3-25 | 1.38 | 55 | 0.38 |
| 3-26 | 1.40 | 50 | 0.30 |
| 3-27 | 1.32 | 60 | 0.35 |
| 3-28 | 1.30 | 60 | 0.28 |
| 3-29 | 1.58 | 70 | 0.21 |
| 3-30 | 1.70 | 75 | 0.36 |
| 3-31 | 1.68 | 70 | 0.29 |
| 3-32 | 1.75 | 75 | 0.35 |
| 3-33 | 1.75 | 75 | 0.34 |
| 3-34 | 1.70 | 75 | 0.34 |
| 3-35 | 1.63 | 65 | 0.37 |
| 3-36 | 1.69 | 65 | 0.33 |
| 3-37 | 1.62 | 65 | 0.32 |
| 3-38 | 1.55 | 60 | 0.34 |
| 3-39 | 1.52 | 70 | 0.33 |
| 3-40 | 1.68 | 70 | 0.39 |
| 3-41 | 1.40 | 70 | 0.32 |
| 3-42 | 1.56 | 70 | 0.41 |
| 3-43 | 1.32 | 70 | 0.29 |
| 3-44 | 1.46 | 70 | 0.36 |
| 3-45 | 1.57 | 70 | 0.25 |
| 3-46 | 1.62 | 70 | 0.29 |
| 3-47 | 1.61 | 70 | 0.32 |
| 3-48 | 1.61 | 70 | 0.30 |
| 3-49 | 1.53 | 70 | 0.24 |

Furthermore, the reversibility of the color development and decolorization was tested by repeating the above operation for color development and decolorization 10 times. As a result, it was confirmed that all the reversible thermosensitive coloring recording media Nos. 3-1 to 3-49 has excellent reversibility.

EXAMPLES 4-1 TO 4-4

The procedure for fabrication of the functional elements Nos. 1-1 to 1-6 in Examples 1-1 to 1-6 were repeated except that the 2-(o-chloroanilino)-6-dibutylaminofluoran employed as the coloring agent in Examples 1-1 to 1-6 was replaced by fluoran compounds shown in TABLE 6, and the phosphonic acids employed as color developers in Examples 1-1 to 1-6 were replaced by octadecylphosphonic acid, whereby functional elements Nos. 4-1 to 4-4 were fabricated.

The decolorization initiation temperature and the decolorization ratio were measured in the same manner as in Examples 1-1 to 1-6. The results are shown in TABLE 6.

TABLE 6

| Ex. No. | Coloring Agent | Decolorization Initiation Temperature (° C.) | Decolorization Ratio (%) |
|---|---|---|---|
| 4-1 | 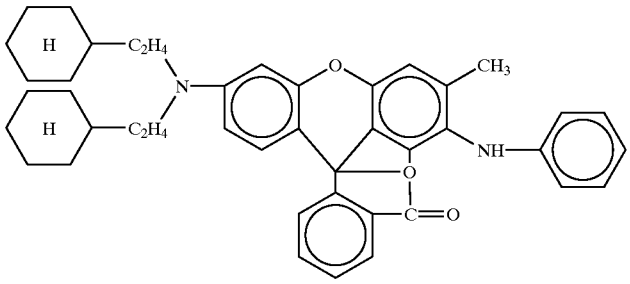 | 59 | 84 |
| 4-2 | 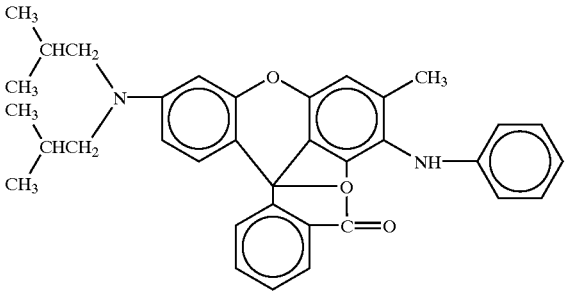 | 64 | 84 |
| 4-3 | 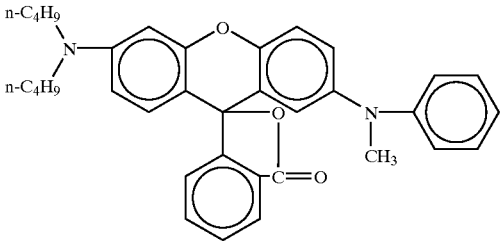 | 62 | 86 |
| 4-4 | 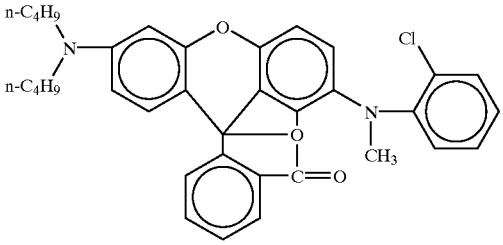 | 64 | 86 |

In the method of reversible selective manifestation of different states of a functional element according to the present invention, the functional element comprises at least two compounds and is capable of alternatively assuming (a) a first state in which the two compounds interact to form a regular aggregate structure, or (b) a second state in which the two compounds do not interact, and at least one of the two compounds is in an aggregate or crystallized state, and the respective conditions for attaining one of the two states can be reversibly and extremely speedily controlled, for instance, by use of thermal means.

The present invention can be utilized in a variety of fields, for instance, in the fields of thermosensitive recording medium and the thermosensitive display medium.

What is claimed is:

1. A method of thermosensitive color recording by manifestation different states of a functional element, which consists essentially of two compounds and is capable of alternatively assuming (a) a first state in which said two compounds interact so as to form a crystallized state in said functional element which enables color recording, or (b) a second state in which said two compounds do not interact, and at least one of said two compounds is in a crystallized state, by heating and cooling said functional element to obtain one of said two states, wherein at least one of said two compounds has a long hydrocarbon chain structure, and said second state is attained by the force of aggregation of said long hydrocarbon chain structure.

2. The method as claimed in claim 1, wherein said first state is attained by fusing said two compounds with the application of heat thereto, followed by rapidly cooling said fused two compounds.

3. The method as claimed in claim 1, wherein said second state is attained by elevating the temperature of said two compounds to a temperature below the temperature at which said two compounds are fused, thereby destroying said crystallized state of said two compounds, and placing at least one of said two compounds individually in a crystallized state.

4. The method as claimed in claim 1, wherein said functional element exhibits a crystallized state when fused and thereafter rapidly cooled, and a state in which at least one of said compounds is in a crystallized state when fused and thereafter gradually cooled.

5. A method of reversible thermosensitive color recording, which comprises:

establishing a colored state of a functional element of the recording layer, formed on a support, of a reversible thermosensitive color recording medium, said functional element selectively manifesting a colored or colorless state between molecules of a coloring agent and molecules of a color developer, the molecules of said color developer having an aliphatic hydrocarbon chain of at least 12 carbon atoms by:

i) heating a solid mixture of coloring agent and color developer to a temperature at which the two materials fuse to form a fused color development state;

ii) rapidly cooling the functional clement in the fused color development state, thereby achieving a first colored state which can be stably maintained at room temperature in which the molecules of coloring agent interact by a combination of relatively weak hydrogen bonding, charge transportation interactive bonding, and coordination bonding forces with the molecules of color developer to form a colored crystallized state of the functional element; and iii) heating the colored material to a temperature below the temperature at which the coloring agent and color developer fuse to destroy the colored state by disrupting the relatively weak bonding forces between coloring agent molecules and coloring developer molecules.

6. A method of reversible thermosensitive color recording employing a functional element which selectively manifests a colored or colorless state, comprising:

establishing a colored state of the functional element consisting of molecules of a coloring agent and molecules of a color developer, the molecules of said color developer having an aliphatic hydrocarbon chain of at least 12 carbon atoms by:

i) heating a solid mixture of coloring agent and color developer to a temperature at which the two materials fuse to form a fused color development state;

ii) rapidly cooling the functional element in the fused color development state thereby achieving a first colored state in which the molecules of coloring agent stably interact by relatively weak bonding forces with the molecules of coloring developer to form a colored crystallized state of the functional element; and iii) heating the colored material to a temperature below the temperature at which the coloring agent and color developer fuse, thereby destroying the colored state by disrupting the relatively weak bonding force interaction between coloring agent molecules and coloring developer molecules, but leaving the crystallized state of the color developer component intact.

7. The method of claim 6, which further comprises, upon obtaining the fused color development state in step i), gradually cooling the functional element in said state thereby causing the complete loss of color of the functional element.

8. The method of claim 6, wherein, in the decolored state, the molecules of the color developer are ordered in a crystallized state, while the molecules of the coloring agent are not in crystallized state.

9. A method of thermosensitive color recording by manifestation of different states of a functional element, which consists essentially of two compounds and is capable of alternatively assuming (a) a first state in which said two compounds, that have been Heated, are rapidly cooled in the functional element thereby forming a color recording, or (b) a second state in which said two compounds, that have been heated, arc gradually cooled thereby failing to interact but in which at least one of the two compounds is in a crystallized state, wherein at least one of said two compounds has a long hydrocarbon chain structure, and said second state is attained by the force of aggregation of said long hydrocarbon chain structure.

* * * * *